United States Patent [19]

Deguchi et al.

[11] Patent Number: 4,640,601

[45] Date of Patent: Feb. 3, 1987

[54] PATENT IMAGE REPRODUCING ELECTROPHOTOGRAPHIC MACHINE

[75] Inventors: Yutaka Deguchi, Himeji; Yasuyuki Tsuchida, Hyogo, both of Japan

[73] Assignee: Sanyo Electric Co., Ltd., Japan

[21] Appl. No.: 683,791

[22] Filed: Dec. 19, 1984

[30] Foreign Application Priority Data

| | | | |
|---|---|---|---|
| Dec. 20, 1983 | [JP] | Japan | 58-241203 |
| Feb. 6, 1984 | [JP] | Japan | 59-20182 |
| Feb. 6, 1984 | [JP] | Japan | 59-20183 |
| Feb. 6, 1984 | [JP] | Japan | 59-20184 |
| Feb. 7, 1984 | [JP] | Japan | 59-20956 |

[51] Int. Cl.[4] ..... G03G 15/00

[52] U.S. Cl. ..... 355/3 R; 355/1; 355/7; 355/14 E

[58] Field of Search ..... 355/1, 3 R, 7, 14 E

[56] References Cited

U.S. PATENT DOCUMENTS

| | | | |
|---|---|---|---|
| 4,376,576 | 3/1983 | Snelling | 355/1 X |
| 4,408,870 | 10/1983 | Nishikawa et al. | 355/1 X |
| 4,435,064 | 3/1984 | Tsukada et al. | 355/1 |
| 4,447,126 | 5/1984 | Heidrich et al. | 355/1 X |

*Primary Examiner*—A. C. Prescott

*Attorney, Agent, or Firm*—Darby & Darby

[57] ABSTRACT

An electrophotographic copying machine includes a photosensitive drum. A first electrostatic latent image according to an original copy image is formed in a state wherein a certain electric charge is accumulated and an original copy image formed by a first light source like a halogen lamp is focussed on this photosensitive drum. In order to form an additional information other than the original copy image, an LED array as a second light source is provided. By the second light source the additional information is formed on the photosensitive drum as the second electrostatic latent image. In case of recording the additional information, a shield member is utilized to prevent the electrostatic latent image by the original copy from being formed in the corresponding region of the photosensitive drum. The photosensitive drum comprises a material like amorphous silicon which is able to react to both first and second light sources.

42 Claims, 56 Drawing Figures

FIG. 14
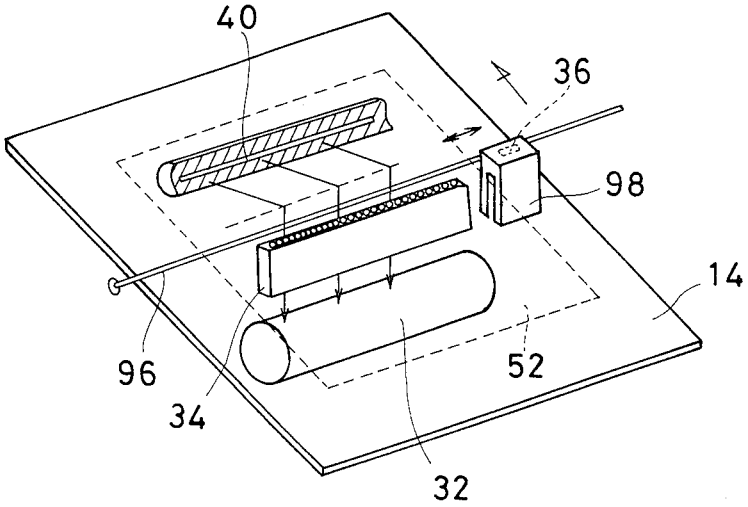
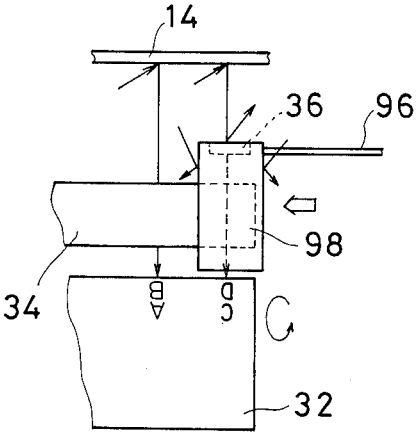
FIG. 15a
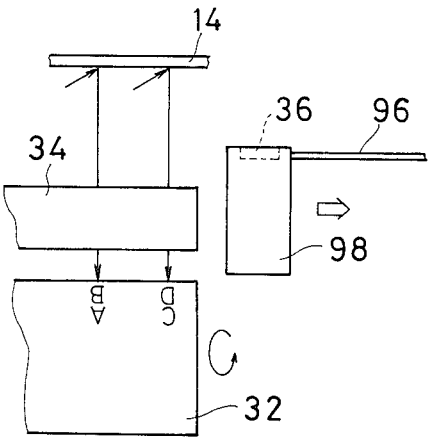
FIG. 15b

FIG. 25
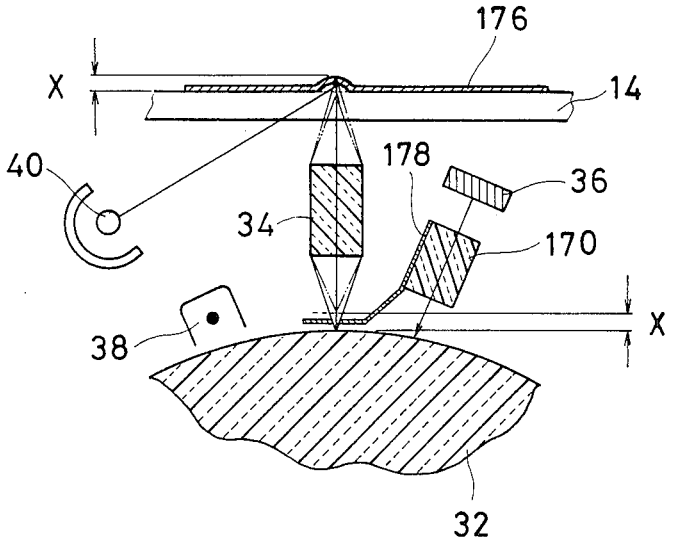
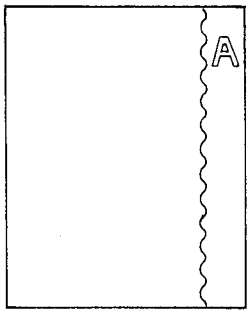
FIG. 26a
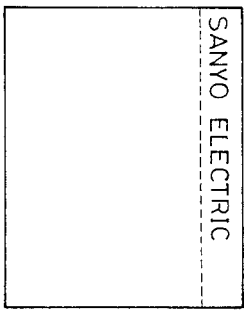
FIG. 26b

FIG. 27
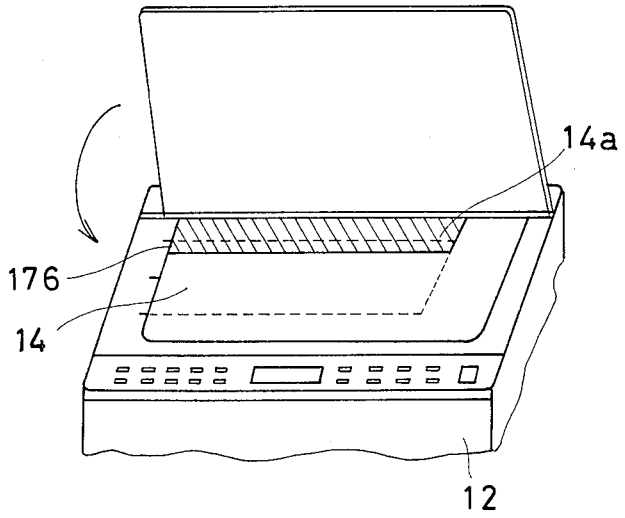
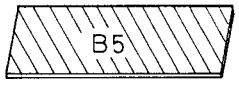
FIG. 28a
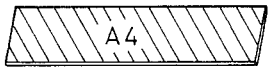
FIG. 28b
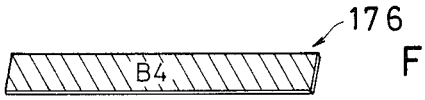
FIG. 28c

192

190

PATENT IMAGE REPRODUCING ELECTROPHOTOGRAPHIC MACHINE

BACKGROUND OF THE INVENTION

1. Field of the Invention

The present invention relates to an electrophotographic copying machine. More particularly, the present invention relates to an electrophotographic copying machine which can form an electrostatic latent image of an additional information other than the original on a photosensitive member in addition to an electrostatic latent image corresponding to the original copy.

2. Description of the Prior Arts

The electrophotographic copying machine of this type was disclosed, for example, in Japanese Patent Publication No. 24785/1983 published on May 23, 1983, Japanese Patent Application Laid Open Nos. 74762/1982, 92247/1979 and 83834/1983 laid open for public inspection respectively on May 11, 1982, July 21, 1979 and May 19, 1983.

The electrophotographic copying machine disclosed in Japanese Patent Publication No. 24785/1983 is constructed in such way that the electrostatic latent image of the additional information other than the original copy image may be formed by the residual charge (350 V) gained by controlling the exposure of the original copy image to one half of the electrified charge on the photosensitive drum, in other words, by controlling the potential of the region where the electrostatic latent image is not formed at 700 V and the region where the electrostatic latent image is formed at 350 V. However, in this prior art, a density of the image is not controllable, nearing that it is not available as a copying machine, except it may be as a printer.

Furthermore, in Japanese Patent Application Laid Open No. 74762/1982 there is disclosed only that the additional or secondary information other than the original copy image or a primary information can be formed but nothing about the definite solutions are disclosed.

In Japanese Patent Application Laid Open No. 92247/1979 an electrophotographic copying machine having a liquid crystal shutter which exposes the additional or secondary informations on the photosensitive drum and a shield means to prevent the projection of the exposed ray for the primary information in the region where the secondary information to be formed as the electrostatic latent image is disclosed. This prior art, however, is aimed to form the additional information by the liquid crystal shutter, accordingly it requires not only an additional light source but also would result in a complex construction.

Moreover, in Japanese Patent Application Laid Open No. 83834/1983, an electrophotographic copying machine using an LED array for the additional information is disclosed. However, there is nothing about the definite instruction on the material of the photosensitive drum in this cited publication. Accordingly, the definite realization of the electrophotographic copying machine experimented by the inventors and others according to the contents taught in Japanese Patent Application Laid Open No. 83834/1983 was impossible even by referring to the contents of Japanese Patent Application Laid Open No. 92247/1979.

SUMMARY OF THE INVENTION

Therefore, a principal object of the present invention is to provide an electrophotographic copying machine which can be realized definitely and forms both images i.e. one corresponding to the original copy and the other of the additional information other than the original copy.

In brief, the present invention is an electrophotographic copying machine wherein a material of the photosensitive member which reacts both to the first light source for exposing the original copy and to the second light source for forming the light image of the additional information is selected.

In a preferred embodiment of the present invention, an LED array is used as the second light source for the additional information. Accordingly, the photosensitive member must be selected to react to the light both from the light source for exposing the original copy, for instance, the first light source such as the halogen lamp and the emitted light from the LED array. If, for instance, the red light is used as the LED array, a wave length of a sensitive peak may be selected at 600–700 nm. One of amorphous silicon, organic photoconductor, Se-Te, CdS and $As_2Se_3$ is available as the material for such photosensitive member. By using such sensitive material and setting the wave length of the sensitive peak of the material to react to the light both from the first light source for exposing the original copy and the second light source for exposing the additional information, the first electrostatic latent image corresponding to the original copy and the second electrostatic latent image corresponding to the additional information may be formed on the common sensitive body. In this respect, none of the publication cited previously have mentioned as stated above.

Meanwhile, as the first light source, the LED array may be available as same as for the second light source. In such case, the luminous wave lengths of two LED arrays may be either equal or different.

In another preferred embodiment of the present invention, a short focal distance lens array is used to focus a light image of the additional information of the second light source, at least, on the photosensitive member. It is also possible to use the short focal distance lens array as a lens system for the original copy image formed by the first light source. In such case, a conjugate length of the short focal distance lens array for the second light source will be selected shorter than that of the short focal distance lens array for the first light source. Thereby, for instance, a halogen lamp, a fluorescent lamp or a green LED array may be used as the first light source and the red LED array having comparatively high luminance intensity may be used as the second light source. Thus by using the short focal distance lens array particularly for the lens system of the second light source, the additional information may be clearly formed.

In a further preferred embodiment of the present invention, a preventing means is provided in the region on the photosensitive member where the electrostatic latent image of the additional information, i.e. the second electrostatic latent image to be formed to prevent the forming of the electrostatic latent image of the original copy, i.e. the first electrostatic latent image. The preventive means consists of a shield member which intercepts the light reflected from the original copy to enter the corresponding region thereof on the photosensitive member. The shield member is preferably, arranged within the depth of focus of the lens system for the original copy, i.e. the first lens system. Thus the boundary between the primary and the additional or the secondary information may be clearly defined.

Meanwhile, such shield member may be used as the LED array proper as the second light source or its holder or the original copy table.

In another preferred embodiment of the present invention, the LED array as the second light source is supported movably generally in generally normal to the lateral direction of the photosensitive member. Accordingly, when only the original copy image is required and the additional inforamtion is not necessary the LED array may be moved just outside of the sensitive region on the photosensitive member. Thus a so-called full space copying is available. The LED array is moved to the prescribed position only when the additional information i.e. the secondary information is required. The position where the additional information is recorded can be set at the desired positions by changing the positions of the LED array.

If the LED array is thus movable the position of the LED array may be changed according to a size of the copying paper. More definitely the size of the copying paper will be detected and the position of the LED array will be set according to the size detected thereby. Accordingly, the additional information can be always formed or recorded in the fixed position, for instance, on the side end of the copying paper for any free size.

In the further preferred embodiment of the present invention, a size of the image of the additional information may be changed. More specifically, the size of the image is changed by changing the scanning frequency and the luminous pulse width of the LED array as the second light source or by changing the speeds of movement or displacement of the sensitive member or by combining the both. Thus the adequate image corresponding to the size of the copying paper may be formed.

In another preferred embodiment of the present invention, an optional information in a plurality of additional information can be selected. For selecting the kinds of additional information a selection key will be used whereby a character signal which indicates the information corresponding to the key will be produced accordingly to the operation of the selection key. For selecting the types a portable recording medium differs in every additional information such as the magnetic card may be also employed. Further, an alphanumeric key may be provided to form or record the additional information as an optional document according to the sequential operation of the alphanumeric key.

These objects and other objects, features, aspects and advantages of the present invention will become more apparent from the following detailed description of the embodiment when taken in connection with the accompanying drawings.

BRIEF DESCRIPTION OF THE DRAWINGS

FIG. 14 is a perspective view showing the state wherein the LED array is moved to the outside of the short focal distance lens array to record only the original copy image.

FIGS. 15A and 15B comprise an illustrated view of a major portion of the LED array holder. In FIG. 15(A) the state is shown wherein the original copy image being intercepted to form the original copy image and the additional information, in FIG. 15(B) the state is shown wherein the original copy image is not being intercepted to form only the original copy image.

In FIG. 16(A) the state is shown wherein the original copy image and the additional information are formed; in FIG. 16(B) the state wherein only the original copy image is formed is shown.

In FIG. 17(A) the state is shown wherein the original copy image and the additional information are formed; in FIG. 17(B) the state wherein only the original copy image is formed is shown.

FIG. 25 is an illustrated sectional side view elevation showing another embodiment of the present invention wherein the shield member is provided within the depth of focus of the short focal distance lens array.

FIG. 26 shows a copying paper being copied. In FIG. 26(A) the state is shown wherein the interception was not made within the depth of focus: in FIG. 26(B) the case wherein the interception was made according to the embodiment in FIG. 25 is shown.

FIG. 27 is an illustrated view showing a preferred embodiment wherein the shield member being disposed on the original copy table.

FIGS. 28A, 28B and 28C comprise illustrated views showing examples of the shield members which are applicable to FIG. 27 and differ in every size of the copying paper.

DESCRIPTION OF THE PREFERRED EMBODIMENTS

Figure 1:
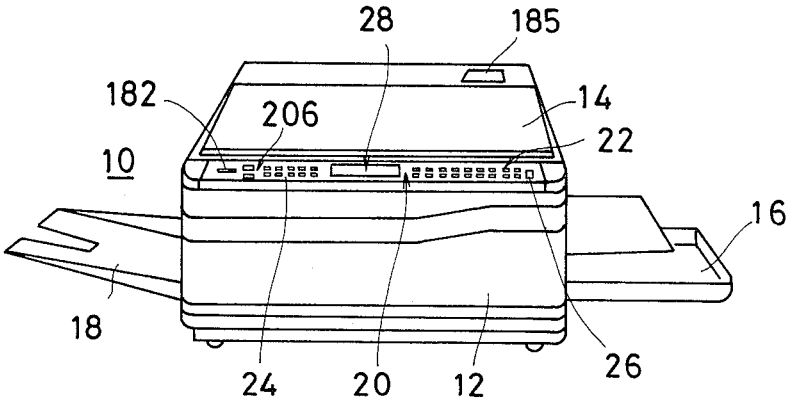
FIG. 1 is an external view showing an embodiment of the present invention.

FIG. 1 is an overall external view showing an embodiment of the present invention. The electrophotographic copying machine 10 includes a body 12, wherein an original copy table 14 being disposed on the upper surface thereof and supported movably in part on right and left. On one end side of the body 12 a paper feeding part is formed for a free engagement of a paper feeding cassette 16, while a paper delivery part including a delivery tray 18 is formed on the other end side of the body 12. Accordingly, an original copy on the original copy table 14 will be recorded on the paper fed from the paper feeding cassette 16 and delivered on the delivery tray 18.

On the upper surface of the body 12 a control panel 20 is formed also, whereon a ten key 22, a selection key group 24 and a start key 16 are provided. The ten key 22 is used for setting the number of sheets for copying and the selection key group 24 is used to select the types of an image other than the original copy image, i.e. the additional information or the secondary information, for instance, a date, a company name and a telephone number and so on. The start key 26 is used to command the start of the copying.

Figure 3:
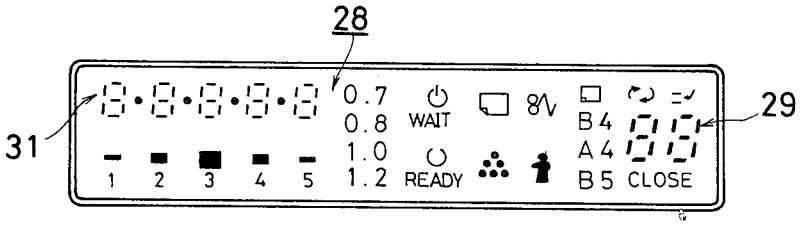
FIG. 3 is an illustrated view showing an example of the display panel.

Further, on the control panel 20 a LCD (Liquid Crystal Display) or a display panel 28 consists of, for instance, liquid crystal are formed, wherein a 7-segment display unit is included for displaying the desired number of sheets for copying and for displaying the types or kinds of additional information selected by the selection key group 24 in numbers as to be described in detail in accordance with FIG. 3.

Figure 2:
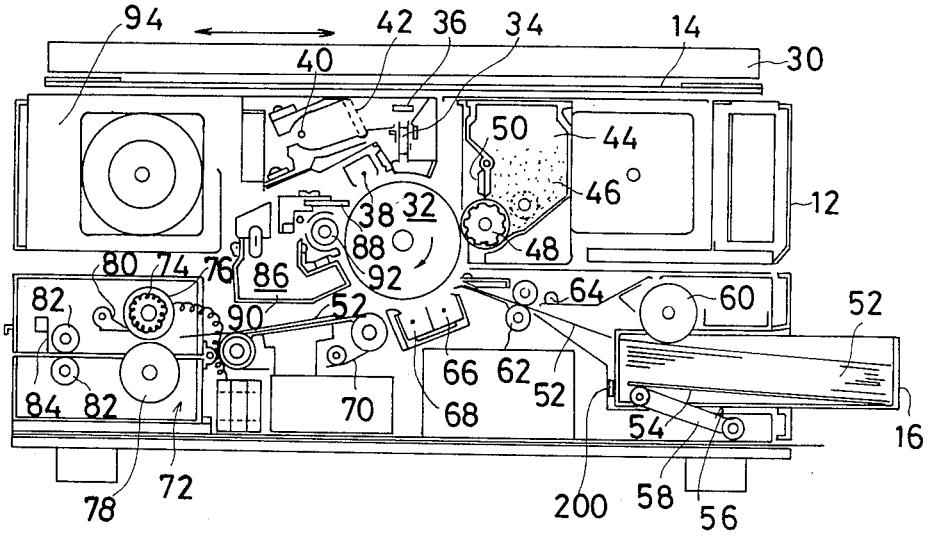
FIG. 2 is a structural illustrated view illustrating an internal structure of the embodiment illustrated in FIG. 1.

Now, an internal construction of the embodiment of FIG. 1 is described referring to FIG. 2 in detail. The original copy table 14 is arranged movably in part on right and left on the upper surface of the copying machine body 12 as aforementioned. The original copy table 14 consists of, for instance, transparent glass, whereon an original copy cover 30 is mounted freely.

In a generally center portion inside of the body 12, a photosensitive drum 32 coated with the photoconductive layer such as amorphous silicon, i.e. the photosensitive member on the circumferential surface thereof is mounted rotatably in a direction shown by the arrow (clockwise direction). Above the top of the photosensitive drum 32 the short focal distance lens array 34 is fixed in such a way that the optic axis thereof will direct generally vertical direction, whereby the image formed by the original copy placed on the original copy table 14 is focussed on the circumferential surface of the photosensitive drum 32. Above the short focal distance lens array 34, there is provided the Light-Emitting Diode array (hereinafter referred to as LED array in the specification) having a monolithic structure as the second light source for forming an electrostatic latent image other than the original copy image on the photosensitive drum 32 to be described in detail.

On an upper stream side of the short focal distance lens array 34 of the rotating direction of the photosensitive drum 32 a charging corotron 38 is provided fixedly to uniformly accumulated charges of positive polarity of approximately 600 V on the photosensitive drum 32. Above the charging corotron 38, there is provided an exposure lamp 40 consists of, for instance, a halogen lamp for exposing rear side of the original copy placed on the original copy table 14. In front of the exposure lamp or the first light source, a filter 42 for absorbing, for instance, infrared rays is disposed.

The electrostatic latent image of the original copy, i.e. the first electrostatic latent image will be formed in the most region on the photosensitive drum 32 by the charing corotron 38, the exposure lamp 40, the short focal distance lens array 34 and the original copy placed on the original copy table 14. Further, the electrostatic latent image other than the original copy, i.e. the second electrostatic latent image will be formed in some region on the photosensitive drum 32.

On a down stream side of the short focal distance lens array 34, in the vicinity of the circumferential surface of the photosensitive drum 32, a developing apparatus 44 for developing the electrostatic latent image as aforementioned by toner is arranged. In the developing apparatus 44, a developer 46 consists of toner and carrier is accumulated. The developer 46 will be transferred toward the photosensitive drum 32 by the magnet roller 48. At this time a crest of developer 46 is formed on the part where the magnet roller 48 faces with the photosensitive drum 32, wherein the end of the crest contacts the photosensitive drum 32 and the negatively charged toner adheres to the electrostatic latent image formed by the positive charge. Thus the electrostatic latent image formed on the photosensitive drum 32 will be developed as the toner image by the developing apparatus 44. Meanwhile, a blade 50 contained in the developing apparatus 44 is used to control the crest height of the developer 46.

In the paper feeding cassette 16 mounted freely engageably on one end side of the body 12, the copying papers 52 are stacked. At the bottom of the paper feeding cassette 16 a supporting plate 54 with the copying paper 52 being placed thereupon is disposed pivotally in a vertical direction. At the lower part of the supporting plate an opening 56 is formed and a free end of a push-up lever 58 having a base end pivotally mounted to the inner bottom part of the body 12 extends therethrough. In relation to the push-up lever 58 a spring (not shown) is provided for forcibly rotating the lever 58 in the clockwise direction and the supporting plate 54 may be pushed upward by the spring. Accordingly, the copying paper 52 contained in the paper feeding cassette 16 in layer will be pushed up by the push-up lever 58 and contacts a feed roller 60 and taken in.

On the rear side of the feeding roller 60 a register roller 62 is provided whereby the copying paper 52 is fed from the paper feeding cassette 16 will be stopped temporarily and thereafrter sent toward the photosensitive drum 32 in synchronization with the movement of the original copy holder 14. Meanwhile, a photo-sensor 64 provided in the vicinity of the register roller 62 is used to detect the existence of the copying paper 52 in that part.

In a space where the copying paper 52 is supplied from the register roller 62 and adjacent to the side of the photosensitive drum 32 a transferring corotron 66 is disposed for transferring the toner image developed by the developing apparatus 44 on the copying paper 52. A separating corotron 68 is provided in a common body with the transferring corotron 66, whereby a A/C corona discharge will be charged to the transferred copying paper and the charge thereof will be neutralized to prevent the copying paper whereon the toner image formed on the photosensitive drum 32 is transferred being absorbed by the residual charge of the photosensitive drum 32.

In the down stream side of the separating corotron 68 a vacuum conveyor 70 is provided to convey the copying paper 52 with the toner image being transferred thereon. The copying paper 52 will be conveyed toward a fixing apparatus 72.

The fixing apparatus 72 comprises a heat roller 78 contacting with the heat roller 76. The fixing takes place when the copying paper 52 with the toner image transferred thereon passes through the two rollers 76 and 78 and being heated and pressed. A click 80 disposed in relation to the heat roller 76 is used to prevent the offset of the fixed copying paper 52 on the heart roller 76. Moreover, at the down stream side of the heat roller 76 a delivery roller 82 is disposed to deliver the fixed copying paper 52 on the delivery tray 18 (FIG. 1); at the down stream side of the delivery roller 82 a sensor switch 84 is arranged to detect the existence of the copying paper 52.

Above the vacuum conveyor 70 aforementioned and adjacent the circumference of the photosensitive drum 32 a cleaning apparatus 86 is provided whereby the residual toner on the photosensitive drum 32 without being transferred on the copying paper 52 will be removed. The cleaning apparatus 86 includes a cleaning blade 88 for scraping the residual toner on the photosensitive drum 32 and a screw conveyor 92 for conveying the toner scraped by the cleaning blade 88 to a toner discharge container 90.

Figure 4:
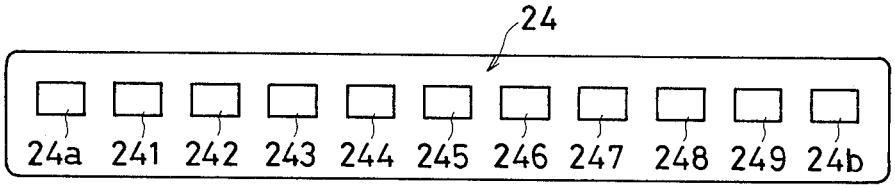
FIG. 4 is an illustrated view showing an example of arrangement of the selection key group for selecting the types of additional information.

For controlling the overall operation of the copying machine and the formation of the additional or secondary information, which are the features of the present invention, a control box 94 is provided, wherein various components, for instance, for the control system as shown in FIG. 4 to be described, are contained.

Referring to FIG. 3, the display panel 28 includes a numerical display 29 which displays the number of sheets to be copied set by the ten key 22 (FIG. 1) and a numerical display 31 which displays the number indicating a kind of additional information selected by the selection key group 24 (FIG. 1). The two display parts 29 and 31 include 7-segment display units respectively. The numerical display 31 includes a plurality (5 in this embodiment) of 7-segment display units, accordingly in the embodiment a plurality of additional informations other than the original copy image can be simultaneously recorded in combination. When, for instance, the key 243 is pressed after, for instance, the key **24*a* of the selection key group 24 to be described later has been pressed, "3" will be displayed on the 7-segment display element at the left end of the numerical display 31**, likewise the number of key operated will be displayed by the display element in order.

Meanwhile, on the display panel 28 a display 1character for displaying the size of paper and so on used on the normal electrophotographic copying machine is formed in addition to the display parts 29 and 31.

The selection key group 24, as shown in FIG. 4, includes a plurality of keys (11 keys in this embodiment) wherein the first key **24*a* is used to command the recording of the additional or secondary informations by using the selection key group 24 and the last key 24*b* is used to indicate the completion of operation for selecting the kind of additional information. For displaying, for instance, 9 information 9 selection keys 241–249** will be provided.

The key 241 is used to command to record either of English or Japanese additional information and when the key 241 is pressed the information in English language will be displayed. The key 242 is used to distinguish the recording direction of the additional information for instance, whether lateral or longitudinal direction of the copying paper and when the key 242 is pressed additional information will be formed in the longitudinal direction. The key 243 is used to record the letter "SECRET" which indicates the necessity of confidential treatment of the additional information. Moreover, keys 244, 245, 246, 247, 248 and 249 are used to select respectively the date, the name of company, the name of section, the address, the telephone number and the slogan as the additional informations. There are various slogans as the addition information. Note that these additional informations are just an example and other optional additional information may be set according to the needs. The additional information corresponding to these keys 243–249 are stored in advanced in the DRAM 144 to be described in connection with FIG. 11 in the digital code corresponding to each number.

At this time the control and operation of the electrophotographic copying machine will be described briefly. The exposed scanning of the original copy starts when the start key is pressed after pressing the desired selection key in the selection key group 24 on the control panel 20 (FIG. 1) and providing the original copy on the original copy holder 14. That is, after moving to the left end the original copy holder 14 returns toward the right direction, whereby the original copy will be slit exposed by the light source 40. The light reflected from the original copy, i.e. the original copy image will be projected and focussed on the photosensitive drum 32 by the short focal distance lens array 34 and thereby the first electrostatic latent image corresponding to the original copy image will be formed on the photosensitive drum 32. At this moment the LED array 36 will be radiated selectively in accordance with the content corresponding to the key operated in the selection key group 24, for instance, the date, etc. and the light image from the LED array 36 will be formed on the photosensitive drum 32 through the short focal distance lens array 34 as the second electrostatic latent image.

The first and second electrostatic latent images thus formed will be developed by toner developing through the developing apparatus 44. The toner image will be then transferred on the copying paper supplied through the register rollers 62 by the transferring corotron 66. The copying paper transferred with the toner image will be separated from the photosensitive drum 32 by the separating corotron 68 and sent to the fixing apparatus 72 by the vacuum conveyor 70. The copying paper will be delivered on the delivery tray 18 by the delivery rollers 82 after the transferred toner image being fixed thereon by the heat roller 76 and the press roller 78.

The excessive toner remained on the photosensitive drum 32 without being transferred will be removed by the cleaning apparatus 86 and the photosensitive drum 32 thus cleaned will be charged positively again by the charging corotron 38.

Referring now in detail to the short focal distance lens array 34 and the LED array 36 in connection with FIG. 5–FIG. 9, wherein the short focal distance lens array 34 includes a plurality of rod lenses which are arranged on the entire width in normal to the rotating direction of the photosensitive drum 32, i.e. to the axial direction thereof. Above the short focal distance lens array 34 a lead screw 96 extending in parallel therewith is rotatably mounted on the body 12. The lead screw 96 is screwed in the screw hole (not shown) formed through a holder 98. Accordingly, the holder 98 is supported and stridden over the short focal distance lens array 34 by the lead screw 96. To one end of the lead screw 96 an output shaft of a stepping motor 100 is connected, accordingly when the stepping motor 100 is energized the lead screw 96 will rotate and the holder 98 may be moved or displaced in the direction shown by the arrow in parallel with the axis of the lead screw 96. Accordingly, the LED array 36 mounted on the holder 98 may be displaced in the direction shown by the arrow. Meanwhile, the exposure lamp 40 is arranged extending in parallel with the short focal distance lens array 34.

Figure 5:
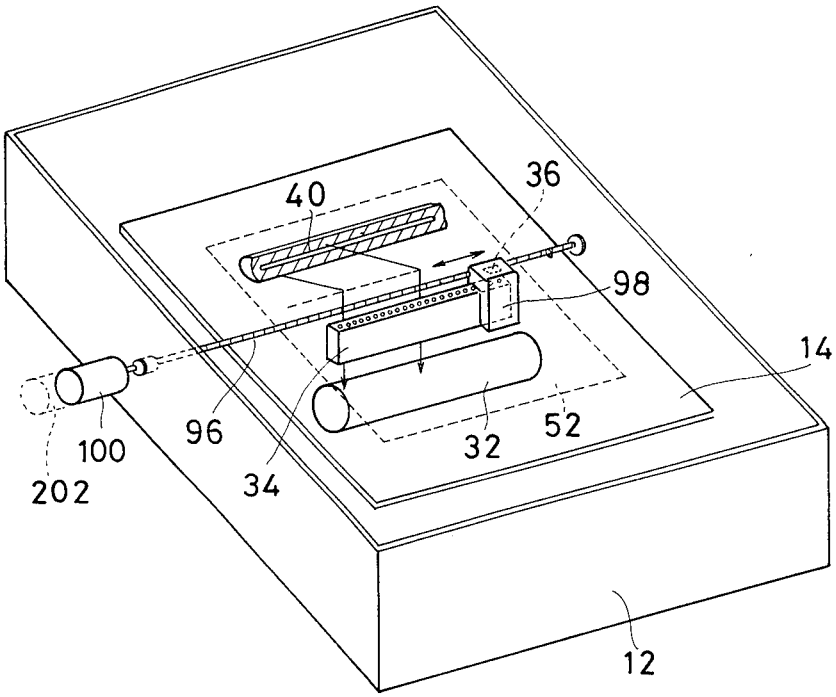
FIG. 5 is a perspective view showing a major portion of the short focal distance lens array and the LED array.
Figure 6:
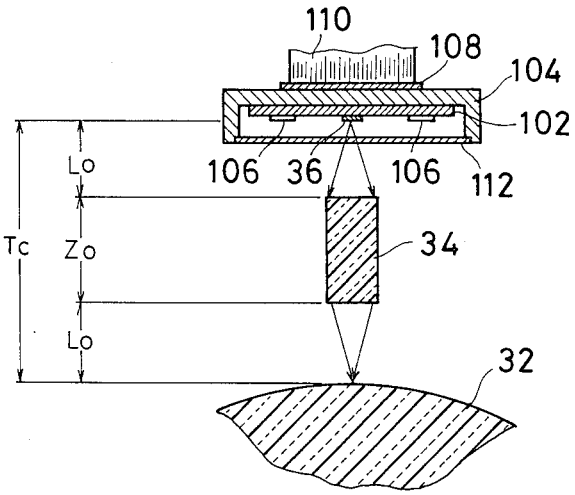
FIG. 6 is a transverse sectional view showing the short focal distance lens array and the LED array.
Figure 7:
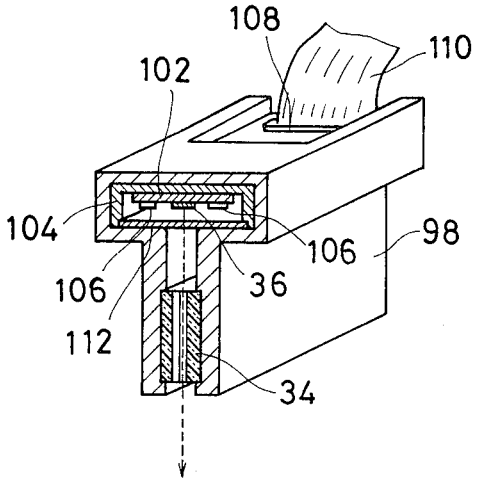
FIG. 7 is a partially cross section perspective view showing the short focal distance lens array and the LED array.

A cross-sectional view of the LED array 36 and the short focal distance lens array 34 along section line in normal to the axial direction of the photosensitive drum 32 is shown in FIG. 6. In FIG. 6, however, the holder 98 (FIG. 5) is not shown. The LED array 36 is fixed to an alumina substrate 102 while the alumina substrate 102 is fixed to a fixing base 104. The fixing base 104 consists of the metal material having a good heat conductivity such as aluminum and also functions as a radiating fin. The fixing base 104 is fixed to the holder 98 (FIG. 5).

Figure 8:
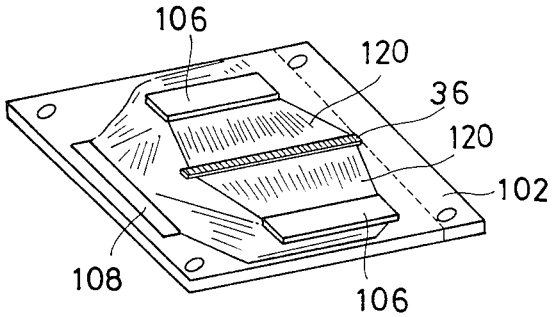
FIG. 8 is a perspective view showing the LED array and an alumina substrate whereon the LED array is formed.

On the alumina substrate 102, as clearly seen in FIG. 8, the LED drivers 106 of an integrated circuit (IC) to drive the LED array 36 is mounted on both sides of the LED array 36. The LED drivers 106 are connected to a connector 108 fixed on the alumina substrate 102 and a flat cable 110 is connected to the connector 108. Accordingly, a lighting driving signal for the LED array 36 will be sent to the LED driver 106 from the control via the flat cable 110 (FIG. 7 and FIG. 8) and the connector 108. At the lower part of the fixing base 104 a transparent glass plate 112 is mounted to protect the LED array 36.

Figure 9:
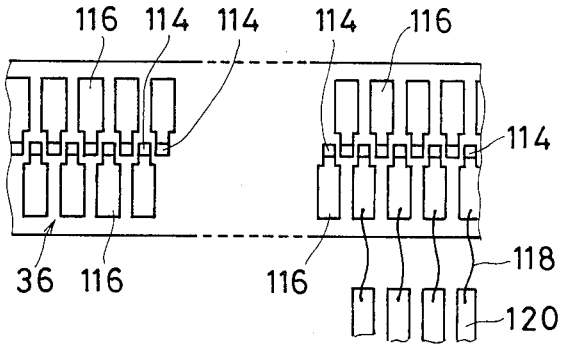
FIG. 9 is a partly enlarged plan view showing the LED array.

A plan view, partly enlarged, of the LED array 36 is shown in FIG. 9. The LED array 36 has a monolithic structure and includes a number of luminous portions 114 arranged in line. In relation with these luminous portions 114 electrodes 116 are formed which are connected to wiring patterns 120 formed on the alumina substrate 102 (FIG. 8) via bonding wires 118. A size of each luminous portion 114 in the LED array 36 is, for instance, $0.07 \times 0.08$ mm, a total length of the array 36 is 14.84 mm and an arrangement pitch of the luminous bodies is 0.106 mm. The numbers of luminous portion of the LED array 36, i.e. the number of dots are 128.

The LED array 36 mentioned above comprises a red LED group formed by, for instance, adding GaAs to the GaAsP base which luminous wave length is 660 nm. While, as the exposure lamp 40 for exposing the original copy the light source radiating the visible rays such as the halogen lamp or the fluorescent lamp is used. In the embodiment shown, the halogen lamp is utilized. A center wave length of the halogen lamp is 500 to 1000 nm and around 550 nm for some types.

In the embodiment, as the photosensitive drum 32 it is required to select the photoconductive material having the wave length of the sernsitive peak which reacts effectively both to this two wave lengths. However, since the light from the LED array 36 is weak when compared with the light from the exposure lamp 40, as the sensitive body 32 it is necessary to select the material reacts sensitively to the light from the LED array 36. Accordingly, in the embodiment, the wave length of the sensitive peak of the photosensitive drum has been selected, for instance, at 600 to 700 nm.

Figure 10:
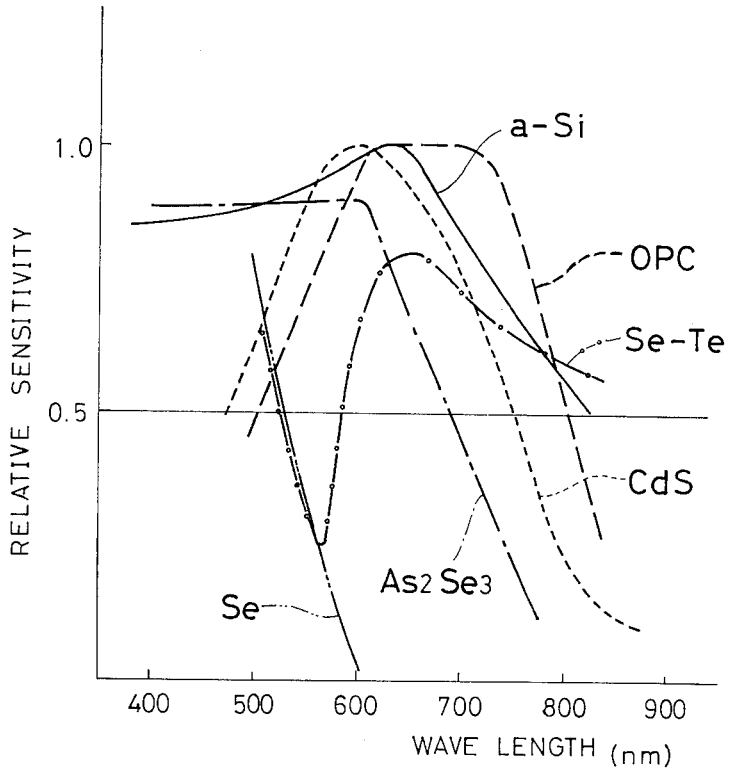
FIG. 10 is a graph showing a relation between the material of the photosensitive member and a relative sensitivity, i.e. a spectral sensitivity characteristic.

More specifically, as the material for the photoconductive layer of the photosensitive drum 32 the material having a spectral sensitivity characteristic as shown in FIG. 10 such as amorphous silicon, OPC, Se-Te, $As_2$-$Se_3$ and CdS are applicable. In the range of wave length of 600–700 nm in FIG. 10 if the relative sensitivity above 0.5 is the applicable condition as the material for the photosensitive drum 32 Se proper is not applicable as the photosensitive drum 32 in the embodiment. Further, as to Se-Te if the same is three layered structure and the content of tellurium (Te) of the intermediate layeras as a photocarrier layer is not within a range of 40–60% it is impossible to conform with the region of wave length as shown in FIG. 10. With respect to OPC, an organic material as disclosed in Japanese Patent Application Laid Open No. 87557/1984 laid open on May 25, 1983 may be used. More definitely, OPC having at least two kinds of pigment or dyestuff which absorbs at comparatively long wave length and short wave length in the different spectral region being mixed is used. For amorphous silicon since it has a positive mechanical characteristic such as a high wear-resisting characteristic besides such sensitive characteristic, it is preferable as the material for such photosensitive drum 32.

If the green LED group is used as the LED array 36 since the luminous wave length is 560 nm, Se proper in the sensitive material shown in FIG. 10 may also become applicable.

In FIG. 6, "Tc", "Zo" and "Lo" show a conjugate length, a length of the short focal distance lens array 34 and a distance between the end face of the short focal distance lens array 34 and the LED array 36 or the sensitive body 32 respectively. These conjugate length Tc and length of the lens Zo relate to each luminous wave length of the exposure lamp 40 as the first light source and the LED array 36 as the second light source.

TABLE

| | Tc(mm) | Zo(mm) | wave length(nm) |
|---|---|---|---|
| Exposure Lamp | 70.3 | 28.5 | 560 |
| LED Array | 16.7 | 8.5 | 660 |

As it is apparent from the above table, since the luminous wave lengths differ between the red LED array 36 and the halogen lamp used as the first light source 40, the length of lens to be used must be changed. Accordingly, in such case, the short focal distance lens array 34 of equal size is not applicable. However, if the green LED is used as the LED array 36 since its center luminous wave length is about 560 nm and same as the halogen lamp the short focal distance lens array 34 of equal size may be used.

Meanwhile, if the first lens system used for the exposure lamp 40 and the second lens system used for the LED array 36 will comprise the short focal distance lens array respectively since the resolution of quantity of light is uniform in its disposed direction when compared with the spherical lens, not only the difference in resolution between the center and the peripheral as in the case of spherical lens can be eliminated but the lighter weight of the unit will give an advantage of reduction of the size of driving motor for moving the unit when compared with the case where the spherical lens being used. Moreover, when using the spherical lens a diameter of the lens must be increased to reduce the F value which results in a large lens shape, on the contrary when reducing the size the F value increases excessively so the quantity of light of the LED array as the second light source becomes problematic, but in case of the short focal distance lens array problems will not occur since the F value is small.

Figure 11:
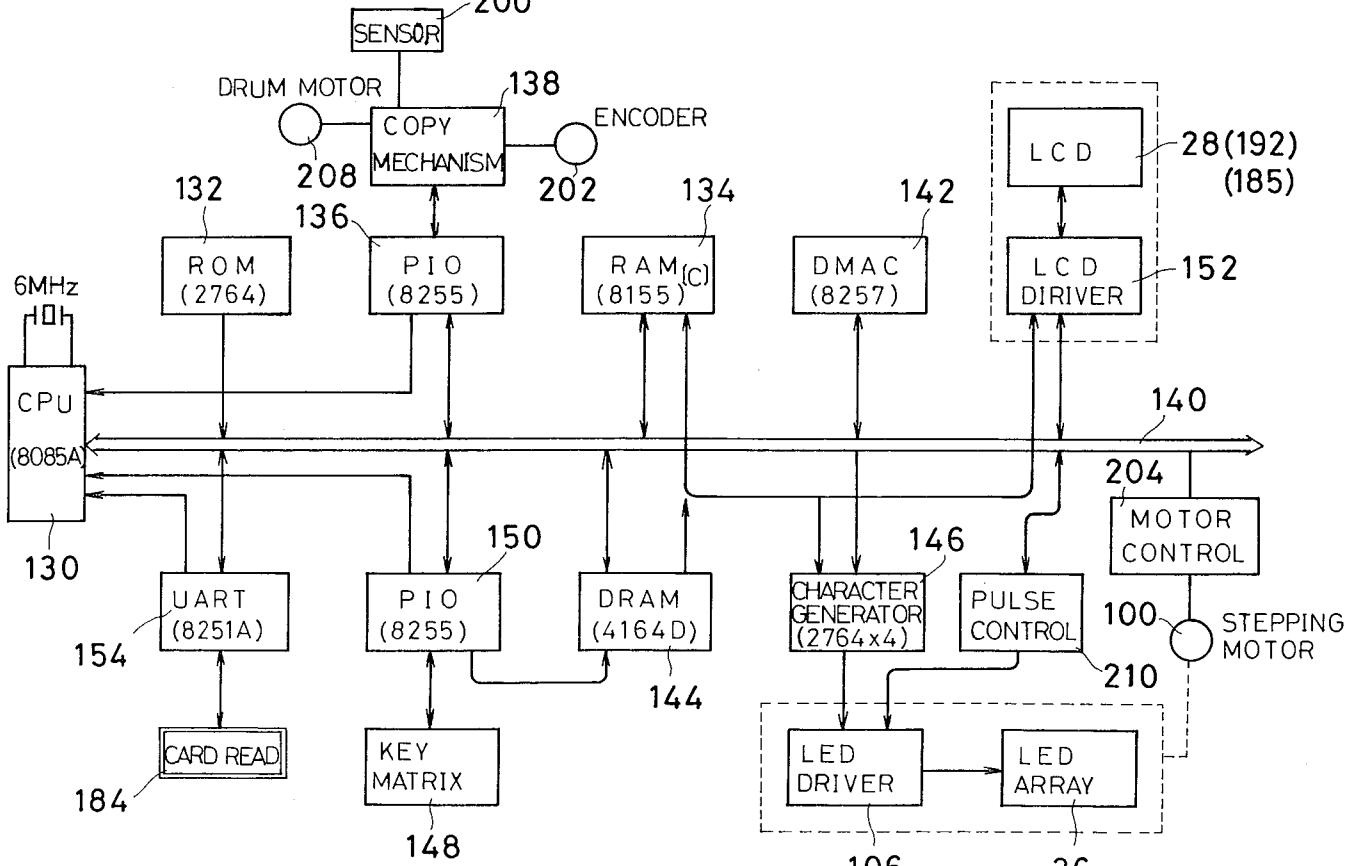
FIG. 11 is a block diagram showing an example of control system of the embodiment.

FIG. 11 is a block diagram showing an example of the control system in the embodiment. In the control system a 8 bits CPU 130 such as μPD8085AC/D-2 by NEC is included. The CPU 130 controls the overall operation of the electrophotographic copying machine and the recording of the addition or secondary information. To the CPU 130 a ROM 132 which stores the control program to be described later and a RAM 134 which stores the date temporarily when the control by the CPU 130 takes place and has regions for the various flags necessary for the control and a counter are connected. As the ROM 132 and the RAM 134, for instance, μPD2764D and μPD8144HC by NEC may be used respectively.

In order to cover the shortage of I/O ports in the CPU130 a programmable input/output interface (PIO) 136 will be provided which functions as the input/output port against a copying mechanism 138 controlled by the CPU 130 and ROM-132. In the copying mechanism 138 all controlling mechanisms for parts related to the operation of the electrophotographic copying machine are integrated.

Components mentioned above will be connected by a bus 140 together with the components for the CPU 130 and others. The bus 140 includes address, data and control buses.

Figure 12:
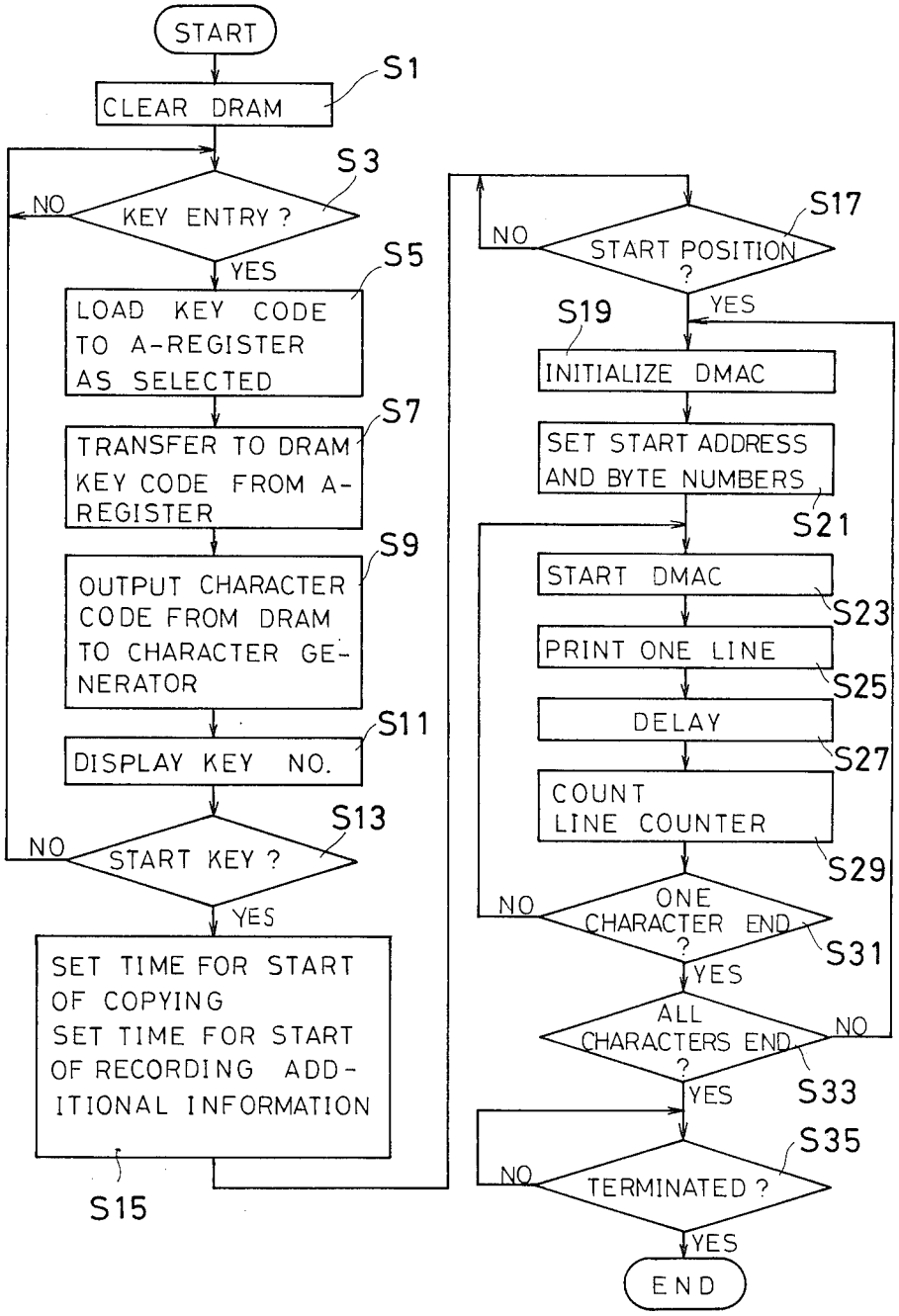
FIG. 12 is a flow diagram illustrating a control or an operation to form the additional information in the embodiment.

To the bus 140 a DMAC (Direct Memory Access Controller) 142 is connected, which selects the contents stored in a DRAM (Dynamic RAM) 144 without being mediated by the CPU 130 and gives directly to a character generator 146. The character generator 146 comprises, for instance, a EPROM which generates the LED driving signal having 32×32 dots based on the character code which indicates the information or contents sent from the DRAM 144 and gives it to the LED driver 106 (ref. FIG. 12). Accordingly, a plurality of luminous portion 114 (FIG. 13) of the LED array 36 which constitutes the second light source are selectively driven to form the necessary character in compliance with the character generator 146, i.e. the contents of the DRAM 144.

As the DMAC 142 and the character generator 146 μPD8257C/D-2 and μPD2764D by NEC can be used respectively.

A key matrix 148 will be connected to the bus 140 via a PIO 150. The PIO 150 is a I/O port as same as the previous PIO 136. To the key matrix 148 the keys described in connection with FIG. 1 and FIG. 4 are connected respectively, accordingly the key matrix 148 is not only the control key for the electrophotographic copying machine but gives the key code signal to the CPU 130 via the PIO 150 by receiving the control signal for selecting the additional information from the key group.

The DRAM 144 mentioned above stores the key code which indicates the kind of additional information selected by the selection key group 24 (FIG. 4). The key code will be stored as the 8-bits data. More definitely, for instance, when the selection key 246 (FIG. 4) is operated, the key code indicating the key 246 is stored in the DRAM 144, which gives the output of the code having respective characters which comprise the additional information "SANYO ELECTRIC CO., LTD." corresponding to the key 246. The character code selects the address of the character generator 146 and the LED driving signal (32×32 dots) corresponding to the successive characters "S-A-N-Y-O . . . " will be given to the LED driver 106 from the character generator 146. Accordingly, the DRAM 144 includes, in the embodiment, a converter which gives the output successively as the code of the character which forms the additional information according to the key code of a number indicating the kind of additional information. However, such converter may be not necessary as to be described in connection with FIG. 31–FIG. 33, if the input means for the additional information includes so-called a performance of the word processor.

Meanwhile, the driving output signal having 32×32 dots is received successively row by row from the character generator 146, accordingly one character will not be formed by the LED array 36 until the driving output signal is received in 32 rows from the LED driver 106.

A LCD dirver 152 is for the display-drive of the display panel or the LCD 28 as shown in FIG. 3. For such LCD 28 the dot-matrix type display may be used.

Moreover, a UART (Universal Synchronous/Asynchronous Receiver/Transmitter) 154 functions as a serial-parallel conversion decoder to which, for instance, μPD8251AFC/D by NEC is applicable. The UART154 is as to be described in connection with FIG. 29 and FIG. 30, used advantageously when the magnetic card is used as the input means for the additional information.

Next, the control or the operation of the embodiment will be described based upon the flow diagram as shown in FIG. 12 and in connection with FIG. 11. Meanwhile, since the control of the operation of the ordinary electrophotographic copying machine is well known mainly the control for recording the secondary or additional information will be described herewith.

At the first step S1 the CPU 130 clears the DRAM 144. Next at the step S3, the CPU 130 decides the input from the key matrix 148, that is if the key is operated after checking the signal from the PIO 150. If the key is operated, at the next step S5, the key code corresponding to the key operated in the selection key 241–249 (FIG. 4) will be loaded on the A-register contained in the CPU 130 (not shown). At the step S7 the CPU 130 transfers the key code corresponding to the content of the A-register, namely the selected key to the DRAM 144. Accordingly, at the next step S9 the code of each character of the additional information corresponding to the operated selection key is produced.

At the step S11 a number of the key code i.e. a kind of additional information will be displayed on the number display 31 of the display panel or LCD 28.

At the next step S13 when the operation of the start key 26 is detected the CPU 130 at the succeeding step S15 sets the timing for the copy start as well as the starting position for recording the additional information, namely the timing.

At the next step S17 when the starting position for the recording, namely the timing is detected the CPU 130 initializes the DMAC 142 at the steps S19. At the next step S21 the start address and the byte numbers to be transferred for the DMA from the DRAM 144 to the character generator 146 will be set.

At the next step S23 the DMA will start operation and as described before the LED array 36 will be driven and an additional information selected by its keys 241–249 will be recorded (steps S25–S31). When the output of LED drive signal for all the characters of the additional information and the completion of printing or recording of all the characters are detected at the step S33, then at the next step S35 the CPU 130 decides if the whole operations related to the copying as the electrophotographic copying machine have been completed and if so the processing routine will end.

Figure 13:
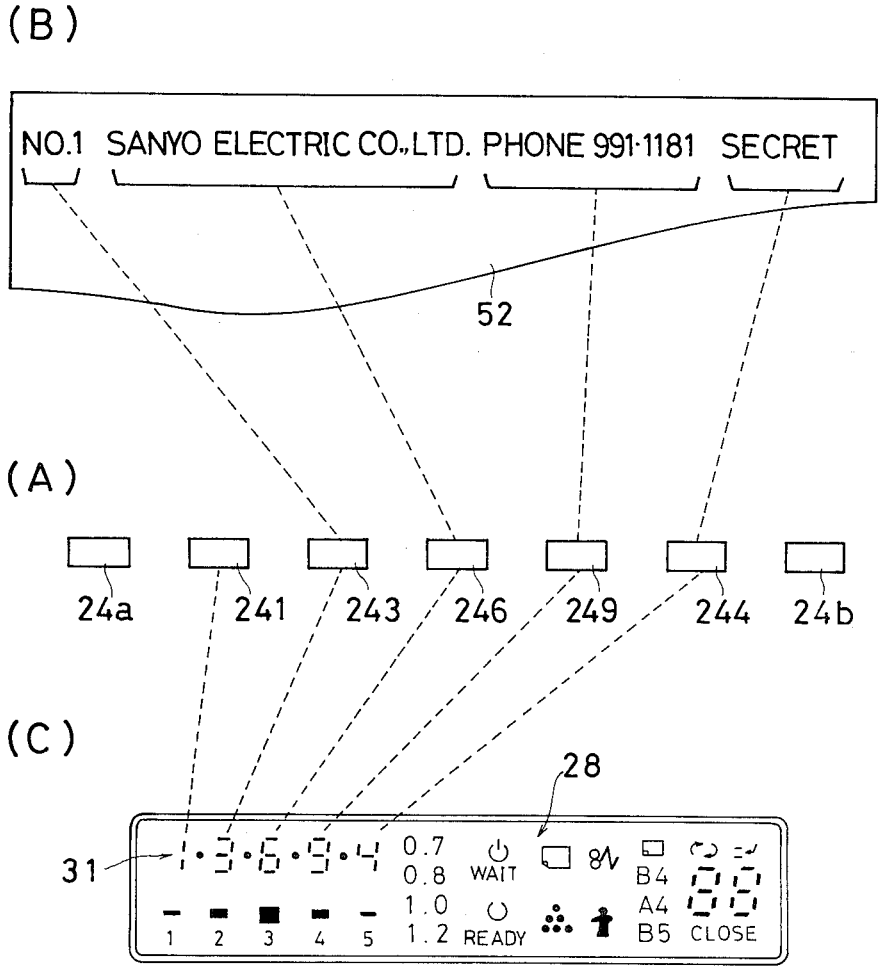
FIGS. 13A, 13B and 13C comprise a view showing an example of additional information formed in accordance with the embodiment.

Such operations will be described in more detail in connection with the embodiment as shown in FIG. 13. Now, as shown in FIG. 13(A) assuming that first the key 24*a* in the selection key group 24 has been pressed. Next the selection keys 241, 243, 246, 249 and 244 have been operated successively and finally the end key 24*b* has been pressed, if the keys were operated in such order, at the number display 31 of the LCD 28 "1.3.6.9.4" will be displayed. And on the copying paper 52, as shown in FIG. 13(B), the information corresponding respectively to the keys 241, 246,249 and 244 will be printed or recorded in English.

As mentioned above when recording other additional information on the same copying paper together with the original copy image, as shown in FIG. 5, the holder for the LED array 36 will be positioned at the end in the axial direction of the photosensitive drum 32, whereby the projection of the image of the original copy will be prevented on the region where the additional information to be recorded. This is for recording the additional or secondary information clearly on the corresponding region. And when only the original copy is needed to be recorded, namely so-called full space copying is required the holder 98 will be moved outside the region of the photosensitive drum 32 by the lead screw 96 by driving the stepping motor 100 (FIG. 5). In this state the original copy image formed by the exposure light source 40 in the whole region in the disposing direction of the shot focus lens array 34 will be recorded.

Referring more in detail, in the state shown in FIG. 5, namely in the state shown in FIG. 15(A) since the holder 98 locates above the region on the photosensitive drum 32 where the additional information to be formed so that original copy image will be not projected on that part. Accordingly, in this state the electrostatic latent images of the original copy (first electrostatic latest image) and the electrostatic latent image of the additional information (second electrostatic latent image) form on the photosensitive drum 32. On the contrary in the state as shown in FIG. 14, namely FIG. 15(B) since the LED array 36 does not locate on the short focal distance lens array 34 the first electrostatic latent image by the original copy will be formed in the whole region on the photosensitive drum 32.

In the embodiment in FIG. 5 the electrostatic latent image of the additional information may be formed in any desired position on the photosensitive drum 32 by displacing or moving the holder 98 by the stepping motor 100. In this occasion, if the holder 98 is moved during the rotation of the photosensitive drum 32 the electrostatic latent image of the additional information may be formed diagonally on the copying paper 52. Further, when only the holder 98 is moved without rotating the photosensitive drum 32 the electrostatic latent image of the additional information may be formed in an orthogonal direction with the moving direction of the copying paper 52 (an orthogonal direction with the axial direction of the photosensitive drum 32).

Figure 16A:
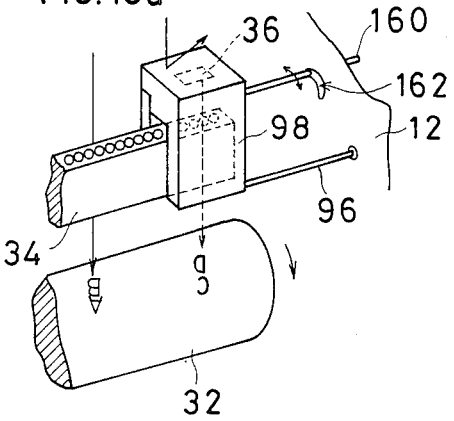
FIGS. 16A and 16B comprise an illustrated view of a major portion of another example of the LED array holder.
Figure 16B:
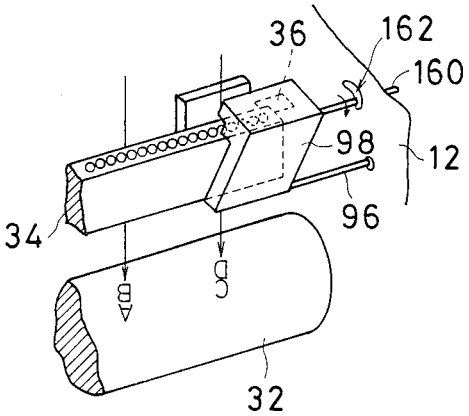

In the embodiment shown in FIG. 16, the holder 98 has an open-and-closed construction at the upper end. When recording the additional information, as shown in FIG. 16(A), the light image of the original copy to the photosensitive drum 32 will be intercepted by the closed holder 44. Accordingly, in the region of the photosensitive drum 32 where the additional information to be formed the first electrostatic latent image by the original copy will be not formed. On the contrary, in the state shown in FIG. 16(B) the upper end part of the holder 98 is opened. Accordingly, in this state, the light image of the original copy will be projected and focussed on the photosensitive drum 32 through the short focal distance lens array 34.

In order to open and close such holder 98, it must be constructed in two separate parts, whereby one part may be supported pivotally at the lower end thereof. For this purpose, a rod 160 is connected to one of the two parts and when the rod 160 is at one end of an aperture 162 formed on the body 12 it will be in the state as shown in FIG. 16(A). And when the stage as shown in FIG. 16(B) is desired, the rod 160 may be forcibly moved to other end of the aperture 162. Then one part of the holder 98 connected to the rod 160 will rotate about the lower supporting end.

Figure 17A:
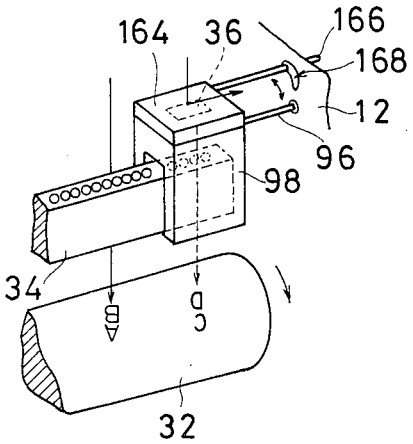
FIGS. 17A and 17B comprise an illustrated view of a major portion of the further example of the LED array holder.
Figure 17B:
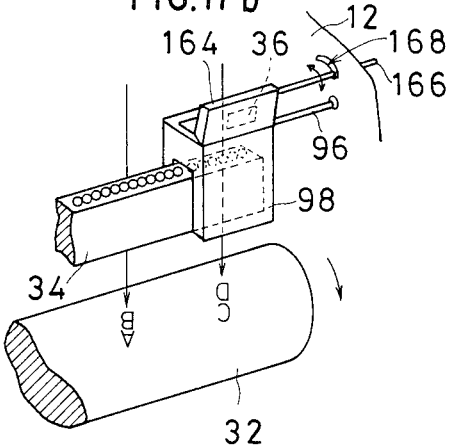

In the embodiment shown in FIG. 17, a lid member 164 having a open-and-closed construction is provided on the holder 98. The lid member 164 is connected to a rod 166 extending through an aperture 168 formed on the body 12. And in the state shown in FIG. 17(A) the lid member 164 is closed by the rod 166. Accordingly, the region on the photosensitive drum 32 just below the holder 98 will be intercepted against the reflected light thus the electrostatic latent image of the original copy will be not formed in that region. On the contrary, in the state shown in FIG. 17(B) wherein the lid member 164 being opened by operating the rod 166, the reflected light from the original copy will be all projected and focussed on the photosensitive drum 32 through the short focal distance lens array 34. Accordingly, in the state shown in FIG. 17(B) so-called full space copying may be possible.

Figure 18:
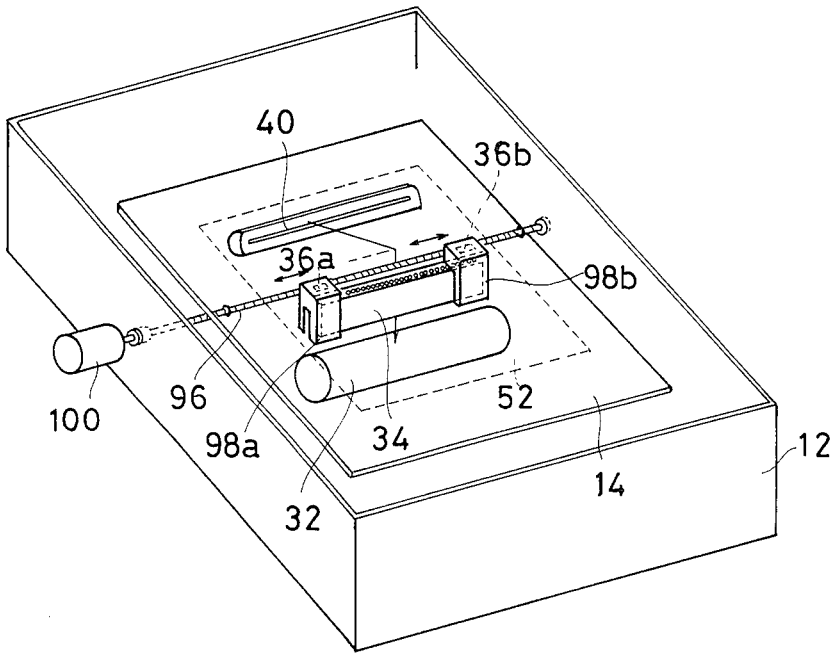
FIG. 18 is a perspective view of a major portion of another embodiment in which two LED arrays are provided.

In the embodiment shown in FIG. 18 two LED arrays 36*a* and 36*b* are disposed to record the additional information. That is, on the lead screw 96 two holders 98*a* and 98*b* are respectively screwed on so as to correspond to the two end positions in the axial direction of the photosensitive drum 32. On the holders 98*a* and 98*b*, as similar to the embodiment in FIG. 5, LED arrays 36*a* and 36*b* are fixed. Accordingly, when the lead screw 96 is rotated by the stepping motor 100 respective holders 98*a* and 98*b*, namely LED arrays 36*a* and 36*b* may be displaced in the direction of arrow shown in FIG. 18. Accordingly, also in the embodiment in FIG. 18 two second electrostatic latent images can be formed in the desired position on the photosensitive drum 32 namely on the copying paper 52.

Figure 23A:
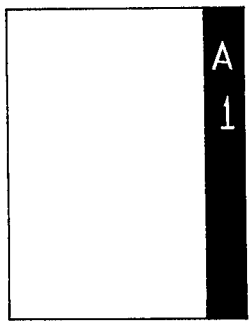
FIGS. 23(A), 23(B), . . . 23(P) are illustrated views showing various examples of additional information being formed in accordance with the present invention.
Figure 23B:
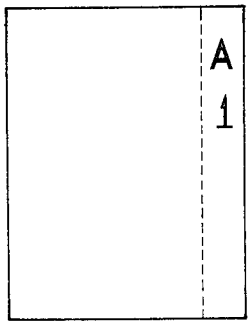
Figure 23C:
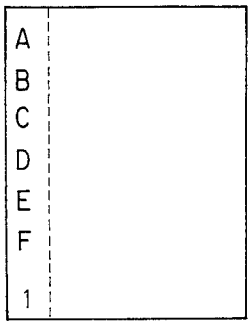
Figure 23D:
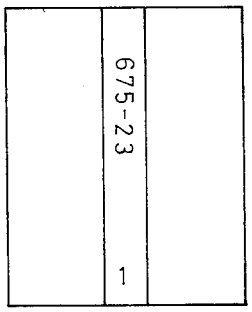
Figure 23E:
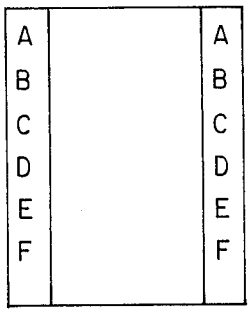
Figure 23F:
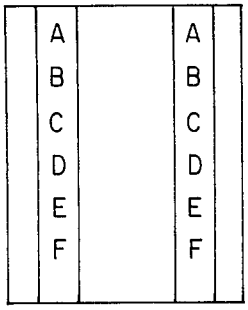

As in the embodiment in FIG. 18, if a plurality of LED arrays 36*a* and 36*b* are provided, as shown in FIG. 23(E) and FIG. 23(F), a plurality of rows of the second electrostatic latent images may be formed on the photosensitive drum 32.

Figure 19:
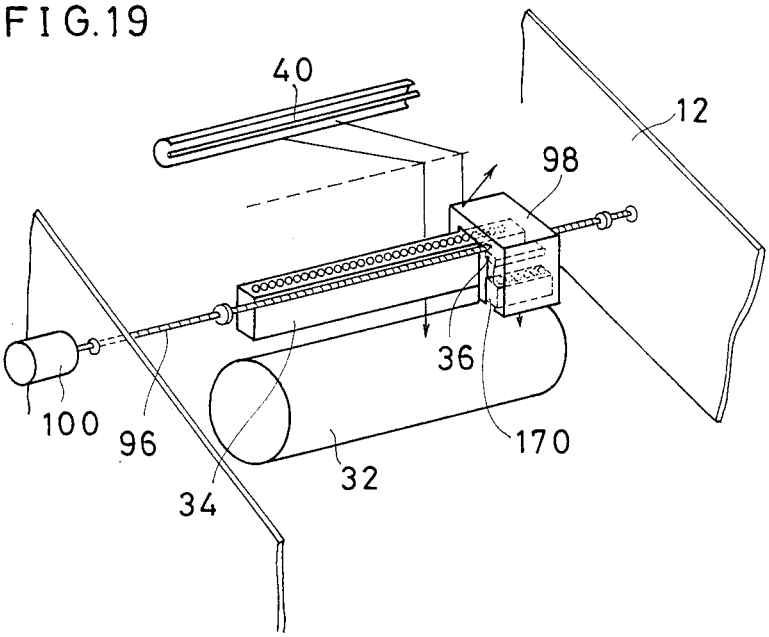
FIG. 19 is a perspective view of a major portion of another embodiment showing mainly the LED array, the holder thereof and the short focal distance lens array.
Figure 20:
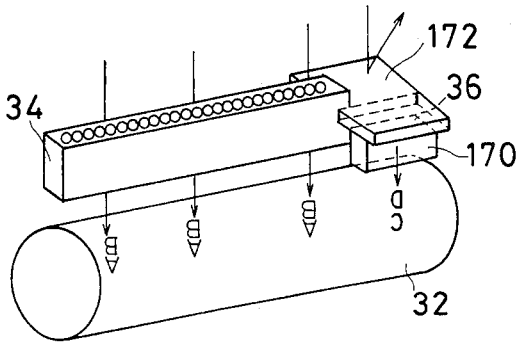
FIG. 20 is a perspective view of a major portion of another embodiment in which the LED array is stationary arranged.
Figure 21:
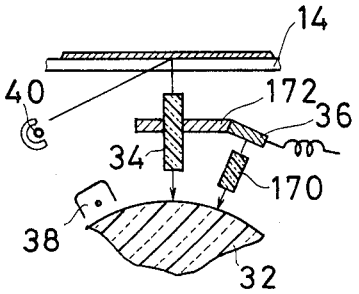
FIG. 21 is an illustrated sectional side elevation view of FIG. 20.

In FIGS. 19–21 another embodiment of the mounting constructions for the LED array are shown. In these embodiments not only the LED array 36 but also an exclusive short focal distance lens array 170 for projecting the light image formed by the LED array 36 on the photosensitive drum 32 is mounted on the holder 98. As such by disposing the exclusive short focal distance lens array 170 against the LED array 36 the LED array may approach closer to the photosensitive drum 32. Consequently a height of the holder 98 can be reduced.

Moreover, in the embodiment in FIG. 19, the holder 98, as similar to the previous embodiment, is supported displaceably in the axial direction of the photosensitive drum 32 by the lead screw 96 connected to the stepping motor 100. The holder 98 fulfills its function to prevent the forming of the electrostatic latent image of the original copy image (first electrostatic latent image) in the region corresponding to the part on the photosensitive drum 32 where the electrostatic latent image of the additional information (second electrostatic latent image) to be formed.

Meanwhile, not only the construction with the holder 98, i.e. the LED array 36 being supported displaceably in the axial direction of the photosensitive drum 32 but also the construction with the LED array 36 being fixedly mounted is applicable. The embodiment thereof is shown in FIG. 20 and FIG. 21.

As shown in FIG. 20 and FIG. 21, in the embodiment, a plate shape holder 172 is fixed at one end in the disposing direction of the short focal distance lens array 34. And at one end in the orthogonal direction with the axial direction of the short focal distance lens array 34 on the holder 172 the LED array 36 is provided and the exclusive short focal distance lens array 170 is mounted between the LED array 36 and the photosensitive drum 32 as is clearly apparent from FIG. 21. As such, if the LED array 36 is fixedly mounted on the short focal distance lens array 34, a position whereon the second electrostatic latent image to be formed may not be changed, but the mechanism or the control circuit is not required to move it, so the construction will be simple and compact as a whole.

Moreover, in the embodiment, the plate shape holder 172 fulfills its function as a screen against the position on the photosensitive drum 32 whereon the second electrostatic latent image to be formed.

Figure 22A:
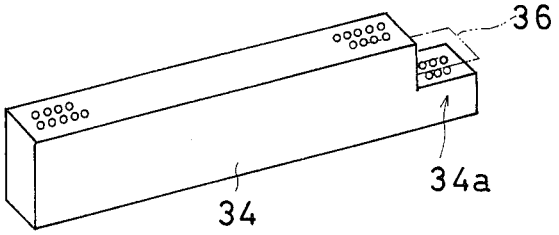
FIGS. 22(A), 22(B) and 22(C) are perspective views respectively showing the major portion of various mounting constructions of the short focal distance lens array.

FIGS. 22(A), (B) and (C) are perspective views showing the major portion and various modes in the embodiment wherein the LED array 36 is fixedly mounted on the short focal distance lens array 34 as shown in FIG. 20. In the embodiment shown in FIG. 22(A) a notched part 34*a* is formed at one end of the disposing direction of the short focal distance lens array 34 as the first lens system for projecting and forming the original copy image on the photosensitive drum and the LED array 36 is arranged thereabove. That is, in the embodiment, the first lens system and the second lens system are commonly using one short focal distance lens array.

Figure 22B:
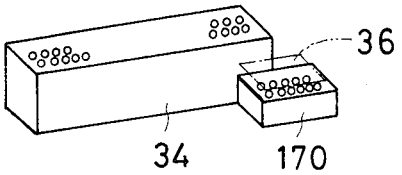
Figure 22C:
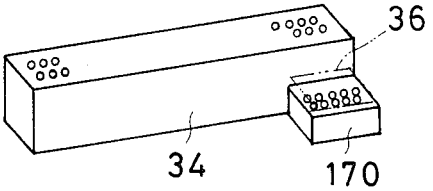

Further, in the embodiment shown in FIGS. 22(B) and (C), the exclusive short focal distance lens array 170 for the additional information are also provided in both cases. In the embodiment in FIG. 22(B) one end of the short focal distance lens array 170 is protruded beyond one end of the short focal distance lens array 34, while in the embodiment in FIG. 22(C) ends of short focal distance lens array 34 and 170 are in same face. In both embodiments a length of the short focal distance lens array for the LED array 36 or the part thereof is shorter than the short focal distance lens array for the original copy image or the part thereof. This is to make in compact as a whole by shorten the distance between the LED array 36 and the photosensitive drum 32 by using the red LED array as the LED array 36.

Figure 23G:
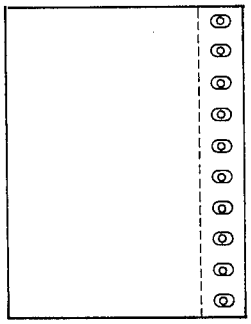
Figure 23H:
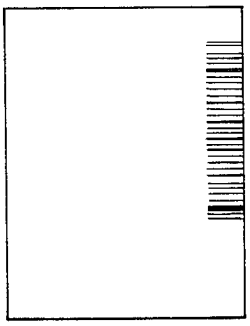
Figure 23I:
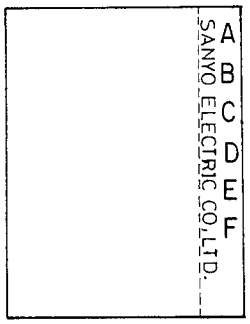
Figure 23J:
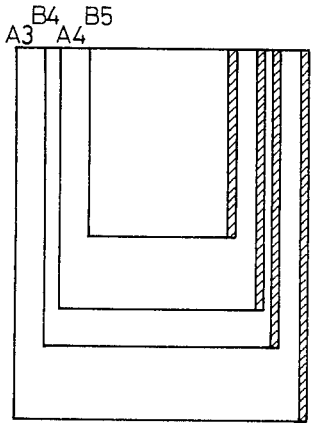
Figure 23K:
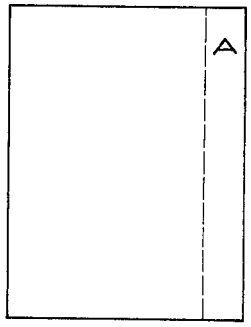
Figure 23L:
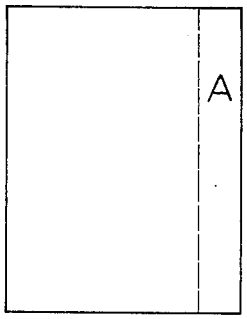
Figure 23M:
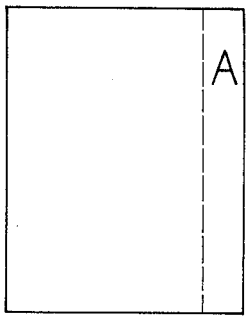
Figure 23N:
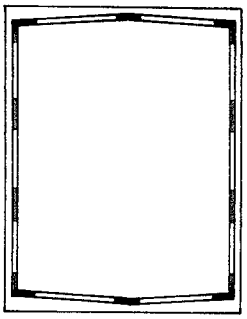
Figure 23O:
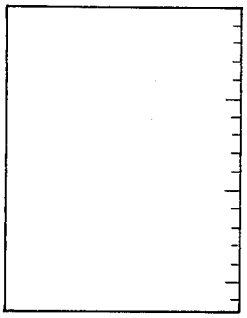
Figure 23P:
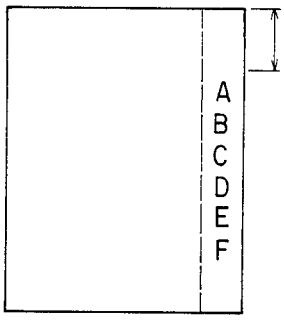

FIGS. 23(A)–(P) are plan views showing various examples of the copying paper with additional information recorded by the embodiments of the present invention.

In FIG. 23(A) a character as "A1" is formed in a white-off print on a black ground as the additional information, in FIG. 23(B) the additional information is recorded in black "A1" on a white ground. Normally when printing on the printer, etc. by the LED array a character in black is formed only on the part corresponding to the luminous part of the LED by the inverse development. However, in case of the electrophotographic copying machine there is a disadvantage that the original copy image will be inversed if the inverse development takes place. Accordingly, in the embodiment, as shown in FIG. 23(A) when forming the character in the white-off print the LED array may be lit corresponding to the shape of the character. However, as shown in FIG. 23(B), when the character is formed normally in black the LED must be lit corresponding to the shape of the background.

FIG. 23(C) shows an example wherein the additional information has been recorded on the left end of the copying paper. In the example a name of the company is recorded as the additional information.

FIG. 23(D) shows, for instance, the additional information being formed in about the center of the copying paper horizontally by moving the LED array by the embodiment in FIG. 5.

FIG. 23(E) shows an example wherein the additional information are recorded on the both ends of the copying paper by the embodiment shown in FIG. 18, FIG.

23(F) shows another example wherein the additional information are recorded in the different positions by moving the LED array. In FIGS. 23(E) and (F) a name and address of the company are recorded as the additional information.

FIGS. 23(G) and (H) show respectively an example wherein the characters other than letters, for instance, figures and bar code patterns are recorded as the additional information.

FIG. 23(I) shows an example wherein vertical letters and horizontal letters are recorded in combination as the additional information.

FIG. 23(J) shows an example wherein the additional information are printed or recorded on the right ends of the copying paper of various sizes. Such recording method of the additional information to be described in detail in connection with FIG. 34A and FIG. 34B.

FIGS. 23(K), (L) and (M) show respectively an example wherein a size of the image of additional information is changed by varying the rotating speed of the photosensitive drum 32 (FIG. 2), wherein the speed increases in order of (K), (L) and (M). Such recording method of the additional information to be described in detail in connection with FIG. 35.

FIG. 23(N) shows an example wherein a framing is formed entirely around the copying paper. In order to record the additional information on the longitudinal end, as described before, the LED array 36 may be displaced or moved along the lead screw 96 (FIG. 5) while the rotation of the photosensitive drum 32 being stopped. Instead of this method, the lead screw 96 may be displaced faster while the rotation of the photosensitive drum 32 is maintained at constant.

FIG. 23(O) shows an example wherein a scale is formed as the additional information.

FIG. 23(P) shows an example wherein a recording of the additional information is started from the position apart by certain distance from the end of the copying paper by setting the timing reasonably at the step S15 in FIG. 12.

Figure 24:
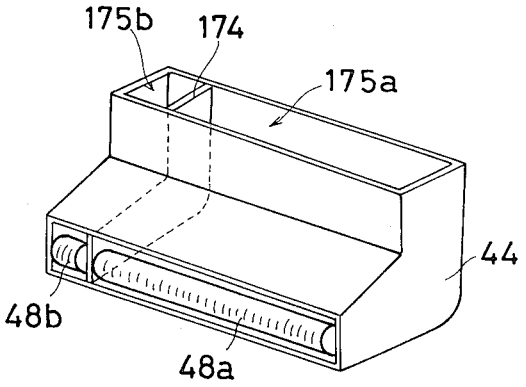
FIG. 24 is a perspective view of a major portion showing another example of the developing means.

FIG. 24 is a perspective view showing a major portion of another embodiment of the developing apparatus. In the embodiment the developing apparatus 44 includes two chambers 175*a* and 175*b* divided by a partition 174, and the developer, i.e. the toner having different colors are stored therein respectively. In relation to the chambers 175*a* and 175*b* the separate magnet rollers 48*a* and 48*b* are provided respectively. The magnet roller 48*a* and the related chamber 175*a* thereof are used for developing the first electrostatic latent image corresponding to the original copy, while the magnet roller 48*b* and the related chamber 175*b* thereof are used to develop the second electrostatic latent image of the additional information. If the developing apparatus 44 of the embodiment is used the original copy image will be recorded in black and other additional information, for instance, a date or the like will be recorded in other color.

Meanwhile, in the embodiment in FIG. 24, since positions of the magnet rollers 48*a* and 48*b* and related chambers 175*a* and 175*b* thereof are difficult to move in the axial direction of the photosensitive drum 32, the recording position for the additional information can not be selected or set optionally.

FIG. 25 is a sectional view showing a major portion of another example of the shield member. If the shield member, namely a means to prevent the forming of the original copy image in the region on the photosensitive drum 32 where the secondary electrostatic latent image of the additional information to be formed, is formed outside the depth of focus of the lens system (in the embodiment the short focal distance lens array 34) for the original copy image, as shown in FIG. 26(A), the image may be not recorded clearly due to an irregular focusing in the boundary. Therefore, in the embodiment in FIG. 25, the shield plates 176 and 178 are disposed within the depth of focus (shown by "X" in FIG. 25) of the short focal distance lens array 34. When the shield plate 176 is used it may be formed on the original copy holder 14 so as to position within the depth of focus for exposing the original by the light source 40. As the shield plate 176 formed on the original copy holder 14 paper or plastic in black color may be used so as to absorb light from the light source 40.

When the shield plate 178 is used it will be disposed so as to position within the depth of focus to focus the reflected light from the original copy exposed by the light source 40 on the photosensitive drum 32. As the shield plate 178 an optional opaque material may be used.

As shown in FIG. 25 if the shield plate 176 or 178 will be arranged within the depth of focus of the short focal distance lens array 34, as shown in FIG. 26(B), a boundary between the original copy image and the additional information will become clear.

FIG. 27 and FIG. 28 show the definite examples of the shield plates 176 and 178. The black plate 176 extending inward from the end part 14*a* of the original copy holder within a region where the additional information to be formed is arranged on the original copy holder 14 in a free engagement. A normal copying may be performed by supplying the original copy on the original copy holder 14 with the screen being arranged thereon. Then, as shown in FIG. 23(A), an image in white-off print may be formed on the black ground. Further such shield plate 176 may be prepared in various sizes corresponding to sizes thereof as shown in FIG. 28.

Figure 29:
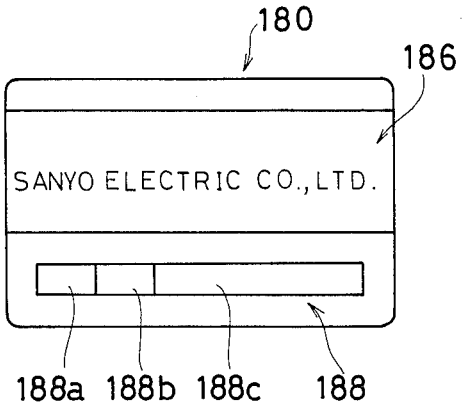
FIG. 29 is an illustrated view showing an example of magnetic card applicable to another embodiment of the present invention.

FIG. 29 is an illustrated view showing a magnetic card 180 used in another embodiment of the present invention. Such magnetic card 180 functions as a selection means for the additional information. When using the magnetic card a card inserting port 182 and a LCD 185 must be provided on the electrophotographic copying machine, as shown in FIG. 1, together with a card reader 184, as shown in FIG. 11, in relation to the inserting port 182. The signal from the card reader 184 is sent to the CPU 130 via the UART 154 and the bus 140.

Returning to FIG. 29, the card 180 includes a visible display region 186 for displaying the additional information to be recorded when the card is used visibly and a code region 188 for storing the additional information digitally in the code signal. Further, the code region 188 comprises three regions 188*a*, 188*b* and 188*c*. The code region 188*a* includes a command to turn on the main switch (not shown). The code region 188*b* includes a name of section or department whereby the magnetic card 180 can be used and in the region 188*c* the character code corresponding to the content displayed in the visible display region 186, in the embodiment, "SANYO ELECTRIC CO., LTD." is formed in the digital signal. By inserting such magnetic card 180 into the card inserting port 182 shown in FIG. 1, a kind and content of additional information other than the original copy image may be selected.

Figure 30:
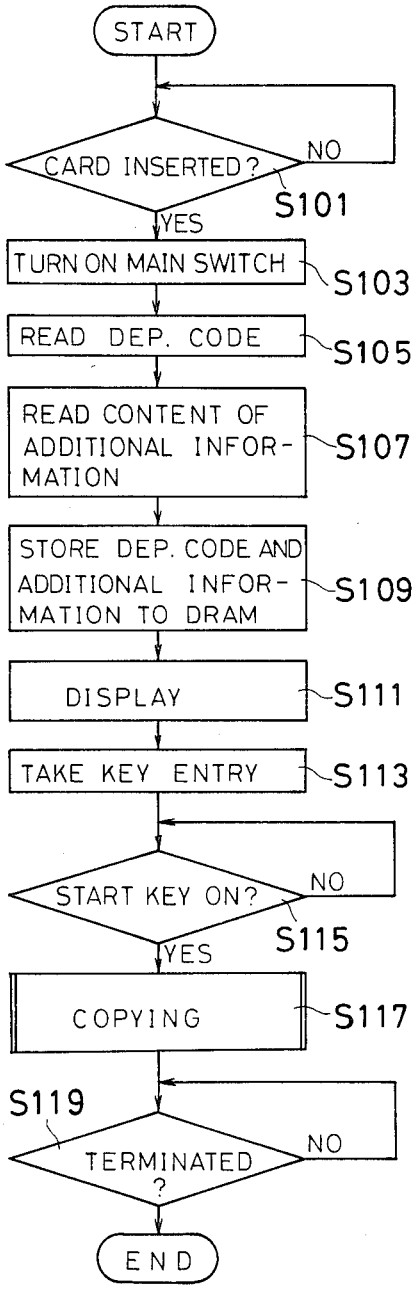
FIG. 30 is a flow diagram illustrating the control or the operation to record the additional information by using the magnetic card shown in FIG. 29.

Referring next to the control or the operation for recording or printing the additional information by using the magnetic card, wherein at the first step S101 in FIG. 30, the CPU 130 checks the data from the UART 154 and decides if the card is inserted into the card inserting port 182 (FIG. 1). If the card is inserted, the CPU 130 outputs the command of turning on the main switch (not shown) at the step S103.

When the main switch is turned on, the card reader 184 (FIG. 11) starts operating and reads the name of section or department and its additional information (at steps S105 and S107). The information read in that manner will be stored in the DRAM 144 as similar to the previous embodiment in FIG. 12. Consequently, as described before, the character code which represents each character of the additional information will be provided to the character generator 146 in succession. Accordingly, the character generator 146 may be able to generate the LED driving signal for each character corresponding to the additional information stored in the magnetic card 180.

Next, at the step S111, the additional information to be recorded by the magnetic card 180 will be displayed in the LCD 185 (FIG. 1).

At the next step S113, the CPU 130 reads the key code from the key matrix 148 and, at the next step S115, decides if the start key 26 (FIG. 1) has been depressed. If the start key 26 is depressed the CPU 130 controls the copying operation in a same manner as the steps S13–S33 shown in FIG. 12. In this occasion, the LED driving signal will be sent to the LED driver 106 from the character generator 146 and the luminous portion 114 (FIG. 13) of the LED array 36 will be lit selectively in accordance with the driving signal, whereby the second electrostatic latent image of the additional information will be formed on the photosensitive drum 32. When the end of copying is decided at the step S117 the routine will be completed.

Figure 31:
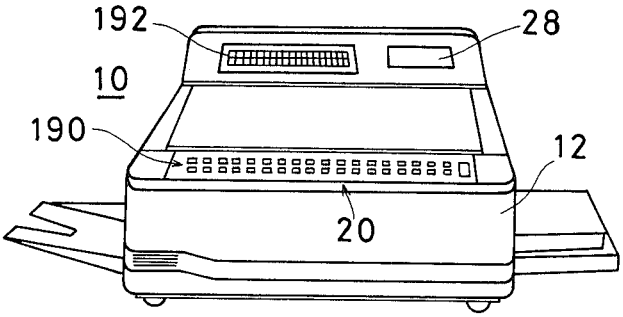
FIG. 31 is an external view showing another embodiment of the present invention.

FIG. 31 is an external view showing another embodiment of the present invention. In the embodiments mentioned above only a fixed content, i.e. a content decided in advance could be recorded or printed as the additional information. On the contrary, in the embodiment, so-called a performance of word processor is added which ensures the recording of any optional information as the additional information. For this purpose on the control panel 20 formed on the body 12 of the copying machine 10 an alphanumeric key 190 which includes 0–9, A–Z and a plurality of keys corresponding to other symbols are arranged. In the embodiment, further, a new LCD 192 is provided together with the LCD 28 as shown in FIG. 3. The LCD 192 is a dot matrix display. In the embodiment, the number display 31 (FIG. 3) of the LCD 28 is not necessary.

Figure 32:
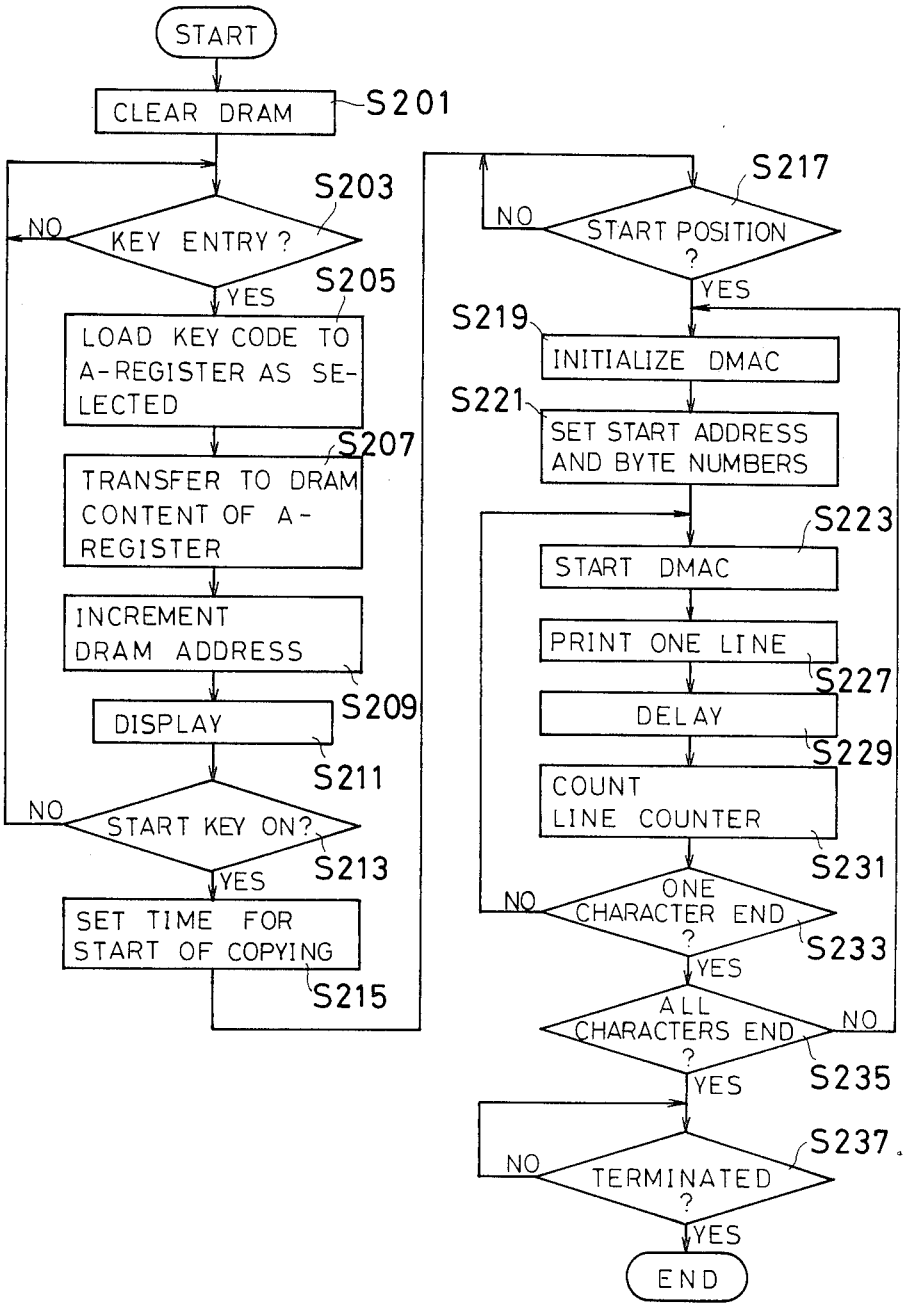
FIG. 32 is a flow diagram illustrating the control or the operation of the embodiment in FIG. 31.

Referring next to the control or operation of the embodiment in connection with FIG. 11 and FIG. 32, wherein at the first step S201 in FIG. 32 the CPU 130 clears the DRAM-144. At the next step S203 when the key entry is detected the key code provided through the key matrix 148 and the PIO 150 will be loaded to the A-register (not shown) in the CPU 130 at the next step S205.

At the step S207 the content stored in the A-register will be transferred to the DRAM 144. The DRAM 144 receives the content in the A-register by incrementing its address at the step S209. Then, at the step S211, the CPU 130 will give the display driving signal to the LCD driver 152 to display in accordance with the input key by the LCD 190 (FIG. 31). Accordingly, at the step S211 the input signal will be displayed by the LCD 192 (FIG. 31).

When the start key is depressed at the step S213, the CPU 130 sets the time or the timing necessary for the copy start in a same manner as at the step 15 in FIG. 12 at the step S215. That is, the start timing for recording the ordinary original copy image and the start timing for recording an additional information will be set and given to the copying mechanism 138 via the PIO 136.

When the start position or timing arrives at the step S217 the CPU 130 gives the command to the DMAC 142 and then first initializes the DMAC at the step S219 and sets the start address and the byte numbers to be transferred at the step S221. The DMAC is started at the step S223 and the key code stored in the DRAM 144 will be transferred directly to the character generator 146. Accordingly, in the character generator 146 the transferred key code is converted into the LED driving signal composed of $32\times32$ dots and corresponding to the key code, then the signal of the first line of the 32 dots signal will be given to the LED driver 106. Thus the printing of the first line takes place (at step S227). In order to take a reasonable interval between the first and second lines, after the delay time at the step S229 the line counter (not shown) starts counting and counts that the first one line of the $32\times32$ dots signal was given to the LED driver 106 from the character generator 146. Thus, at the step S233 the end of one character will be decided by deciding if all 32 lines signals for the display driving signal have been sent out. This operation will be repeated until the end of all characters has been confirmed at the next step S235, then the end will be finally decided at the step S237.

Figure 33C:
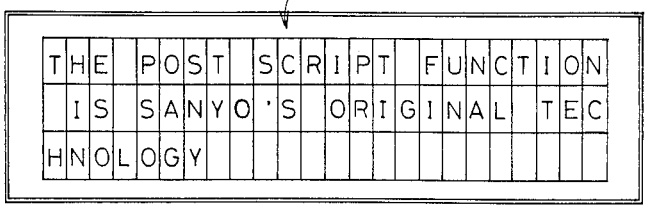
FIGS. 33A, 33B and 33C comprise an illustrated view showing an example of additional information formed in accordance with the embodiment in FIG. 31.
Figure 33A:
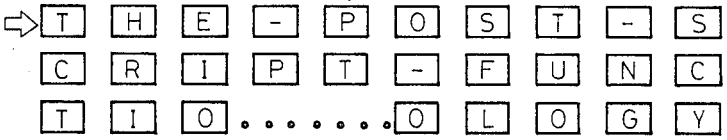
Figure 33B:
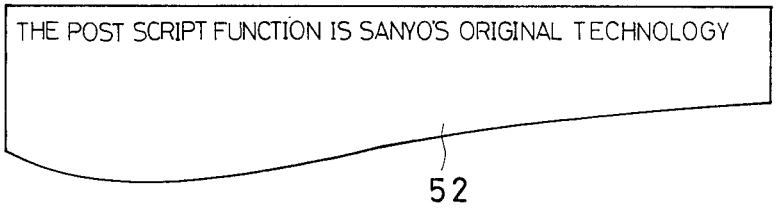

The additional information formed in accordance with the embodiment is shown in FIG. 33. When the alphanumeric key 190 is operated in order as shown in FIG. 33(A) the display corresponding thereto will be made in the LCD 192 as shown in FIG. 33(C). Then the additional information will be formed on the photosensitive drum as the second electrostatic latent image by the LED array 36 and, as shown in FIG. 33(B), the additional information corresponding to the key operation will be printed or recorded on the copying paper 52.

Figure 34A:
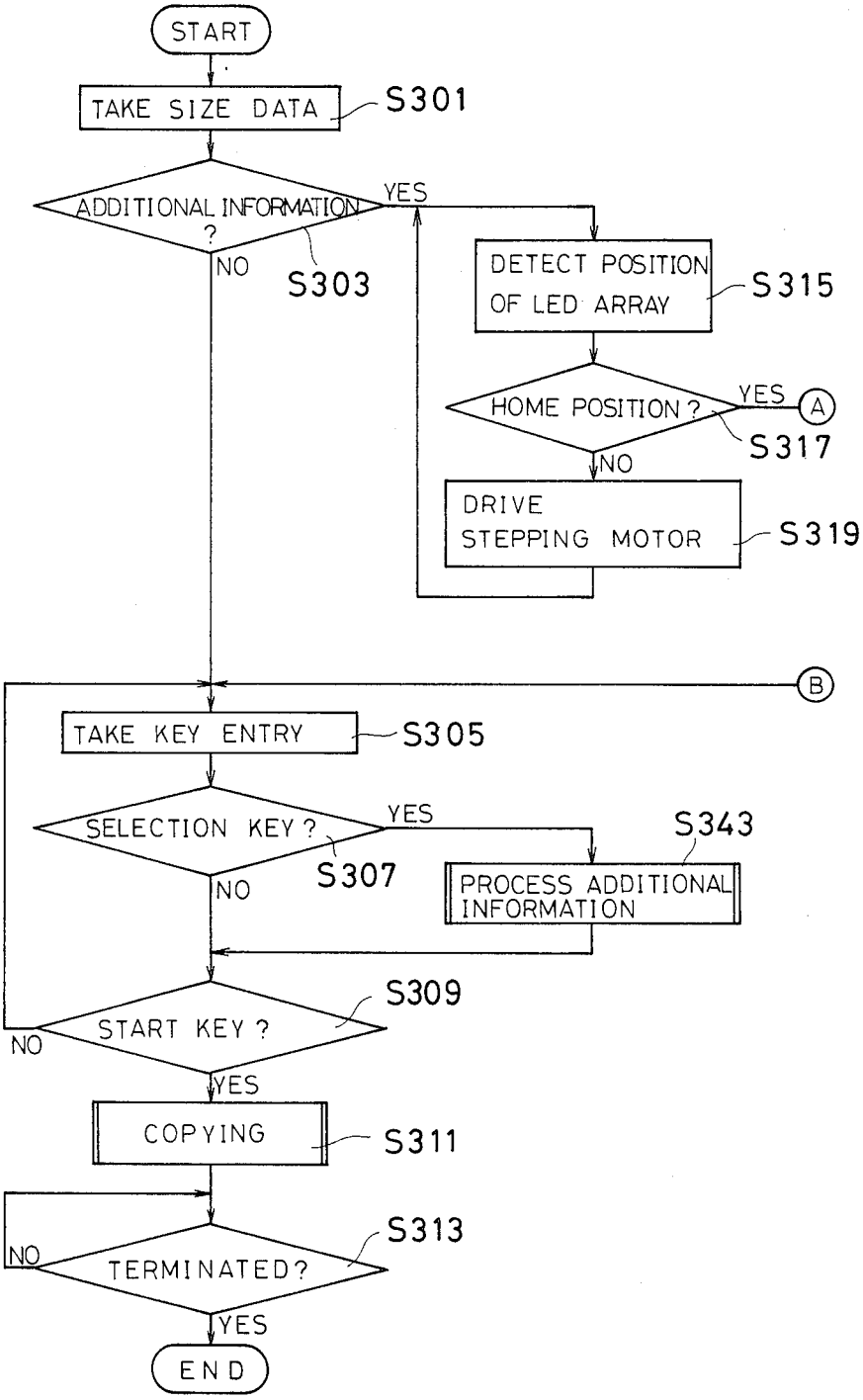
FIG. 34A and FIG. 34B are flow diagrams illustrating the control or the operation of another embodiment of the present invention.
Figure 34B:
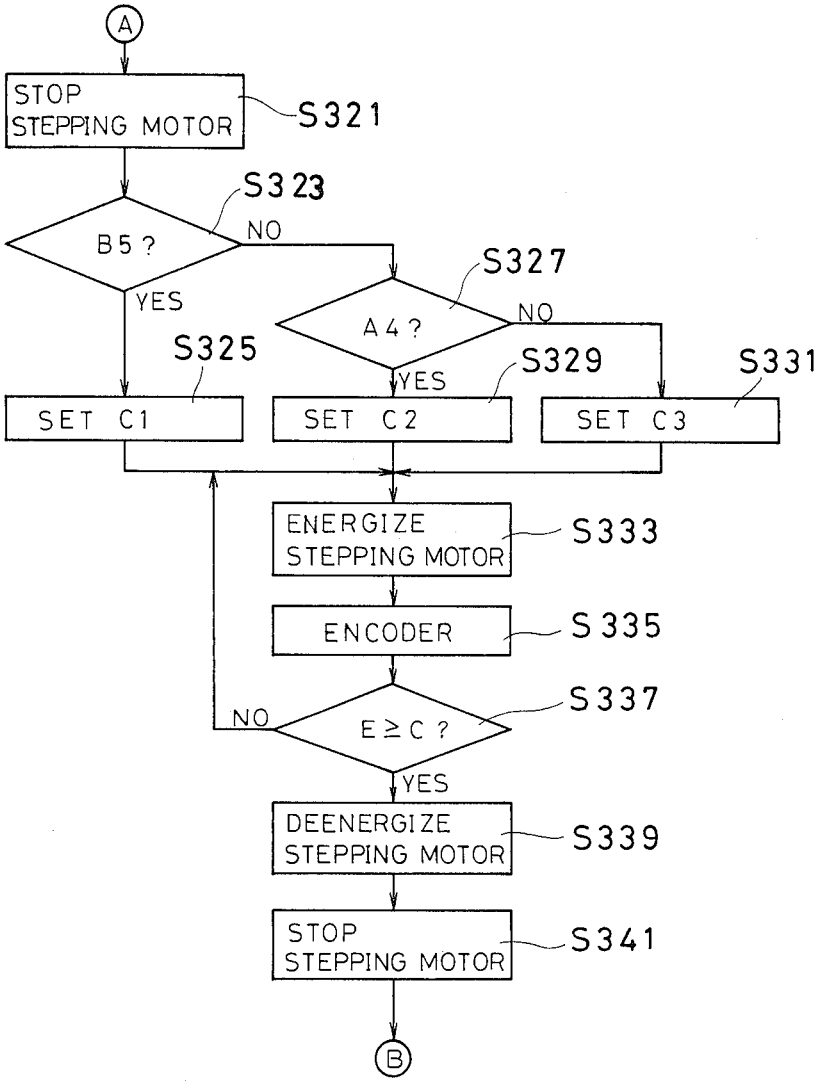

FIG. 34A and FIG. 34B are flow diagrams for illustrating the control or operation of another embodiment of the present invention. The embodiment is applied for printing or recording the additional information always in the proper position against the different sizes as shown in FIG. 23(A).

In the embodiment, as shown in FIG. 2, a size sensor 200 is provided in relation with the paper feeding cassette 16 mounted on the paper feeding part. The size sensor 200 includes a means for reading a size indicator (not shown) formed machine readably on the paper feeding cassette 16. If the size indicator consists of, for instance, a projection which indicates the size by the position where it is formed, then a micro-switch having an actuator which will be pushed by such projection is preferable as the above means included in the size sensor. From the size sensor 200, as shown in FIG. 11, the signal indicating respective sizes "B5", "A4" and "B4" will be given to the CPU 130 via the copying mechanism 138, the PIO 136 and the bus 140.

Further, in the embodiment, as shown in FIG. 5, a encoder 202 is used. The encoder 202 is provided in relation with the stepping motor 100 for rotating the lead screw 96 and generates a pulse train or strings sign which includes a predetermined number of pulses at every rotation of the stepping motor 100, i.e. the lead screw 96. The pulse string from the encoder 202 will be provided to CPU 130 via the copying mechanism 138, as shown in FIG. 11. Accordingly, in the CPU 130 a movement and a stopping position of the holder 98 of the LED array 36 can be detected in accordance with the pulse string from the encoder 202. Then the movement and the stopping position of the LED array 36 will be sent to a motor control 204 (FIG. 11) from the CPU 130 via the bus 140. Thus the movementand, etc. of the LED array 36 will be fed back to the stepping motor 100 controlled by the motor control 204.

Referring next, in connection with FIG. 34A and FIG. 34B, to the control or the operation for changing the forming position of the additional information by moving the LED array 36 corresponding to the size of the copying paper as shown in FIG. 23(J), wherein at the first step S301 in FIG. 34A, the CPU 130 receives the data on the kind of paper feeding cassette 16, i.e. the size of copying paper 52 in accordance with the signal from the size sensor 200.

At the next step S303, the CPU130 decides if the command for printing or recording the additional information is given in accordance with the key input from the PIO 150 (or the card information from the UART 154). If the recording of the additional information is not required the processing will proceed to the step S305.

If the recording of the additional information is not required the CPU receives the key input at the step S305 and decides if the start key 26 has been operated at the step S309. When the start key 26 is operated the CPU 130 gives the command to copying mechanism 138 via the PIO at the step S311 and starts the ordinary copying operation.

If the printing or recording of the additional information is required the CPU 130 decides the position of the LED array 36 at the step S3154 and decides if the LED array is in the reference position or home position at the step S317. Such decision may be made in accordance with the signal from the position sensing switch (not shown) installed on the lead screw 96 (FIG. 5). If the LED array 36 is not the home position the CPU 130 gives the control signal to the motor control 204, accordingly at the step S319 the motor control 204 sends the driving pulse to the stepping motor 100 till the LED array is positioned in that home position. Then at the step S317 if the position of the LED array 36 in the home position is detected the processing will proceed to the step S321 in FIG. 34B and the CPU 130 gives the signal to the motor control 204 and stops the rotation of the stepping motor 100.

Next, the CPU 130 will decide the size in accordance with the signal from the size sensor 200. If the size of the copying paper is detected as "B5" at the step S323, the CPU 130, at the next step S325, sets the pulse number (this is the pulse to be supplied to the stepping motor 100) corresponding to the movement amount of LED array 36 in accordance with the size "B5" to a counter (not shown) formed in prescribed region of the RAM 134 (FIG. 6) as the count value (C1).

If the size "A4" is detected at the step S327, the CPU, at the step S329, sets the pulse number corresponding to the movement amount of the LED array 36 according to the "A4" copying paper to the counter mentioned above as the count value (C2).

Further, if it is detected at the step S327 that the size is not "A4", the CPU 130 decides the size as "B4" and sets the count value (C3) corresponding to size "B4" to the counter at the step S331.

Thereafter, the CPU 130 gives the signal to the motor control 204 at the step S333 and energizes the stepping motor 100. Corresponding to the rotation of the stepping motor 100 the pulse will be given to the CPU 130 from the encoder 202 (step S335) and the CPU 130 will decide "E≧C" at the next step S337. That is, the CPU 130 compares the number pulses of the pulse strings from the encoder 202 and the count values C1, C2 or C3 set at the steps S325, S329 or S331 and continues the energizing of the stepping motor 100 till the former becomes equal to the latter. Next, if "E=C" is detected at the step S337 the CPU 130 gives the signal to the motor control 204 at the step S339 and deenergize the stepping motor, consequently the rotation stops at the step S341. In this state the LED array 36 is positioned in the position corresponding to the size "B5", "A4" or "B4", that is, in the position corresponding to the near end side of each size of the copying paper. Thus, as shown in FIG. 23(J) the additional information may be recorded in the position corresponding to each size.

Referring next to the embodiment, whereby the size of the additional information may be changed as shown in FIGS. 23(K), (L) and (M) and a scale magnification setting key 206 disposed on the control panel 20, as shown in FIG. 1 will be used. When the magnification setting key 206 is operated a size of the image other than the original copy image namely the additional or secondary information can be changed to desired sizes. Further, in the embodiment, a drum motor 208 for driving the photosensitive drum 32 (FIG. 2) can be controlled by a drum motor control (not shown) included in the copying mechanism 138 so that the rotating speed of the drum 22 can be changed. A pulse controller 210 (FIG. 11) is provided in relation with the LED driver 106 which controls the light emitting of the LED array 36. The pulse controller 210 changes the pulse width or the frequency of the LED drive signal given to the LED drive signal given to the LED driver 106 in accordance with the command from the CPU 130. Accordingly, the scanning frequency and the luminous pulse width of the LED array 36 will be changed.

There are three methods to change the size of the additional information. One is to change the scanning frequency and/or luminous pulse width of the LED array 36 while the rotating of the photosensitive drum 32 is maintained at a constant speed. The other one is to change a rotating speed of the photosensitive drum 32, i.e. the drum motor 208 without changing the scanning frequency, etc., of the LED array 36. It can be considered as the third one to change not only a rotating speed of the photosensitive drum 32 but also the scanning frequency, etc. of the LED array 26 simultaneously. In this case various sizes of the additional information may be formed according to combinations of variations. Further, in case of the second method, a size of the additional information image can be changed only lengthwise in the rotating direction of the photosensitive drum 32 as shown in FIG. 23(K), (L) and (M).

Referring next to the control or operation of the embodiment which changes the size of additional information in connection with FIG. 35, wherein the explanation will be made that the size of the additional information will be changed automatically in accordance with the signal from the size sensor 200 shown in FIG.

2 and FIG. 11 and not the magnification setting key 206. However, it must be indicated in advance that the similar operation may be made when changing the size of the additional information by the magnification setting key 206 as shown in FIG. 1. Moreover, in the embodiment, a rotating speed of the photosensitive drum 32 and the scanning frequency, etc. of the LED array 36 are changed simultaneously according to the third method.

Figure 35:
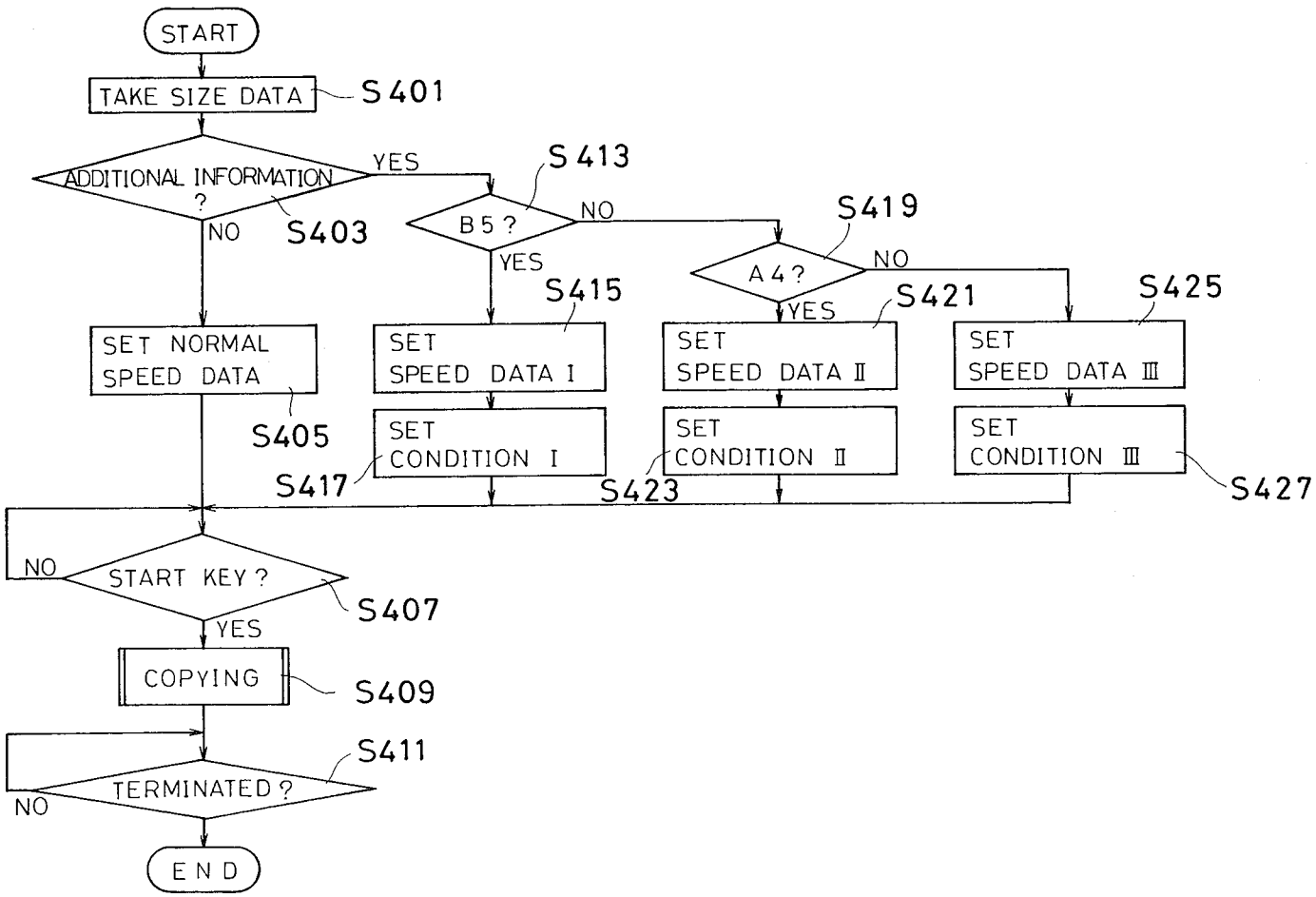
FIG. 35 is a flow diagram illustrating the control or the operation of still another embodiment of the present invention.

At the first step S401 in FIG. 35, the CPU 130 takes the data on sizes of the copying paper as same as at the step S301 in FIG. 34A. Next, at the step S403 the CPU 130 decides if the command to print the additional information is provided. If the command is not provided, at the step S405, the CPU 130 commands the ordinary speed of the drum motor 208 to the copying mechanism 138. Then the copying operation takes place at the step S409 after detecting the control of start key at the step S409.

When the CPU 130 decides that the command to record the additional information has been provided at the previous step S403 then it will firstly decide if the size is "B5" at the next step S413. If the size then is "B4" the CPU 130 sets the speed data I (max. speed) to the copying mechanism 138 at the step S415 together with the luminous condition 1 (max. scanning frequency and min. luminous pulse width of the LED array 36) to the pulse control 210 at the step S417. Then the image of the additional information will be printed or recorded in a minimum size as shown in FIG. 23(K).

When the size "A4" is decided at the step S419 the speed data II and the driving condition II of the LED array will be set at the steps S421 and 423. Consequently, the photosensitive drum 32 will be driven at a medium speed and the LED array 36 will be lit at a medium scanning frequency and a medium luminous pulse width. Accordingly, in this case, a medium size of the additional information image will be formed as shown in FIG. 23(L).

When it is decided that the size is not "A4" at the step S419, the CPU 130 decides the size then is "B4" and sets the speed data III and the luminous driving condition III at the next steps S425 and S427. Consequently, the photosensitive drum 32 will be driven at a minimum speed and the LED array 36 will be at a minimum scanning frequency and a maximum luminous pulse with. Accordingly, in this case, the additional information will be formed in the largest size as shown in FIG. 23(M).

Although the present invention has been described and illustrated in detail, it is clearly understood that the same is by way of illustration and example only and is not to be taken by way of limitation, the spirit and the scope of the present invention being limited only by the terms of the appended claims.

What is claimed is:

1. An electrophotographic copying machine comprising:

a photosensitive member, charging means for charging said photosensitive member, a first light source for exposing an original copy, first electrostatic latent image forming means for forming an original copy image formed by said first light source on said photosensitive member as a first electrostatic latent image, additional information providing means for providing an additional information other than said original copy, displaying means for displaying said additional information, a second light source for forming an image of said additional information, and second electrostatic latent image forming means for forming said additional information image formed by said second light source on said photosensitive member as a second electrostatic latent image, said photosensitive member including a material sensitive to both said first and second light sources, further developing means for developing said first and second electrostatic latent images formed on said photosensitive member by toner as a toner image, and transferring means for transferring said toner image formed by said developing means on paper.

2. An electrophotographic copying machine in accordance with claim 1, wherein said second light source includes an LED array.

3. An electrophotographic copying machine in accordance with claim 2, wherein a wave length of sensitive peak of said photosensitive member is selected at 600–700 nm.

4. An electrophotographic copying machine in accordance with claim 3, wherein said photosensitive member includes a photoconductive member which consists of one selected from a group of a-Si, OPC, Se-Te, CdS and $As_2Se_3$.

5. An electrophotographic copying machine in accordance with claim 4, wherein said photoconductive member includes an OPC which consists of a mixture of at least two kinds of pigment or dyestuff which absorbs a light at comparatively long and short wave lengths in different spectrum regions.

6. An electrophotographic copying machine in accordance with claim 1, wherein said second electrostatic latent image forming means includes a second lens system for focussing the light image of said additional information formed by said second light source on said photosensitive member, said second lens system includes a second short focal distance lens array.

7. An electrophotographic copying machine in accordance with claim 1, wherein said additional information providing means includes means for generating a digital signal as said additional information.

8. An electrophotographic copying machine comprising:

a photosensitive member, charging means for charging said photosensitive member, a first light source for exposing an original copy, first electrostatic latent image forming means for forming an original copy image formed by said first light source on said photosensitive member as a first electrostatic latent image, said first electrostatic latent image forming means including a lens system having a given depth of focus and for focussing said original copy image onto said photosensitive member, a second light source for forming an additional information other than said original copy image, and a shield member located within said depth of focus for preventing said first electrostatic latent image from being formed in the region of said photosensitive member where an electrostatic latent image of said additional information is to be formed, second electrostatic latent image forming means for forming said additional information formed by said second light source on the portion shielded by said shielding member of said photosensitive member as a second electrostatic latent image, said photosensitive member including a material sensitive to both said first and second light sources, further developing means for developing said first and second electrostatic latent images formed on said photosensitive member by toner as a toner image, and transferring means for transferring said toner image formed by said developing means on paper.

9. An electrophotographic copying machine in accordance with claim 8, wherein said second light source includes the LED array, said shield member includes a shielding surface formed on said LED array.

10. An electrophotographic copying machine is accordance with claim 8, wherein said second light source includes a holding means for holding said LED array, said shielding means including a shielding surface formed on said holding means.

11. An electrophotographic copying machine in accordance with claim 8, which further comprises an original copy holder for placing said original copy, wherein said protective means includes a shielding plate provided in a corresponding position of said original copy holder.

12. An electrophotographic copying machine in accordance with claim 11, wherein said shielding plate includes a light absorbing material for absorbing light from said first light source.

13. An electrophotographic copying machine in accordance with claim 12, wherein said light absorbing material includes a black member.

14. An electrophotographic copying machine comprising:

a photosensitive member, charging means for charging said photosensitive member, a light source for exposing an original copy, first electrostatic latent image forming means for forming an original copy image formed by said light source on said photosensitive member as a first electrostatic latent image, an LED array which includes GaAsP LED elements for forming an additional information image other than said original copy image, and second electrostatic latent image forming means for forming said additional information formed by said LED array on said photosensitive member as a second electrostatic latent image, said photosensitive member including a material sensitive to both said light source and said LED array, further developing means for developing said first and second electrostatic latent images formed on said photosensitive member by toner as a toner image, and transferring means for transferring said toner image formed by said developing means on paper.

15. An electrophotographic copying machine in accordance with claim 14, which further comprises a moving means for moving at least one of said original copy and said first light source, and a displacing means for displacing said sensitive means in relation to the movement of at least one of said original copy and said first light source by said moving means, wherein said first electrostatic latent image forming means includes a first lens system for focussing said original copy image onto said photosensitive member, and said first lens system includes a first short focal distance lens array extending in a direction generally normal to a displacing direction of said photosensitive member by said displacing means.

16. An electrophotographic copying machine in accordance with claim 15, wherein said second electrostatic latent image forming means includes a second lens system for focussing a light image of said additional information formed by said second light source on said photosensitive member, and said second lens system includes a second short focal distance lens array.

17. An electrophotographic copying machine in accordance with claim 16, wherein said first and second short focal distance lens arrays include the common short focal distance lens array, and a conjugate length of said second short focal distance lens array is selected shorter than that of said first short focal distance lens array.

18. An electrophotographic copying machine in accordance with claim 16, wherein said first and second short focal distance lens arrays comprise each separate short focal distance lens array, and a conjugate length of said second short focal distance lens array is selected shorter than that of said first short focal distance lens array.

19. An electrophotographic copying machine comprising:

a photosensitive member, charging means for charging said photosensitive member, a first light source for exposing an original copy, moving means for moving at least one of said original copy and said first light source, displacing means for displacing said photosensitive member in relation to the movement of at least one of said original copy and said first light source, first electrostatic latent image forming means for forming an original copy image formed by said first light source on said photosensitive member as a first electrostatic latent image, a second light source including an LED array and for forming an additional information other than said original copy image, and supporting means for supporting said LED array movably generally normal in a displacing direction of said photosensitive member by said displacing means, second electrostatic latent image forming means for forming said additional information formed by said LED array supported movably on said photosensitive member as a second electrostatic latent image, said photosensitive member including a material sensitive to both said first and second light sources, further developing means for developing said first and second electrostatic latent images formed on said photosensitive member by toner as a toner image, and transferring means for transferring said toner image formed by said developing means on paper.

20. An electrophotographic copying machine in accordance with claim 19, wherein said first electrostatic latent image forming means includes a first lens system for focussing said original copy image on said photosensitive member, said first lens system includes a first short focal distance lens array extending in a direction generally normal in the displacing direction of said photosensitive member by said displacing means, said first short focal distance lens array being disposed generally parallel in a moving direction of said LED array.

21. An electrophotographic copying machine in accordance with claims 20, wherein said supporting means is formed outside the side ends in lateral direction of said photosensitive member, whereby said LED array may be moved outside the photosensitive region of said photosensitive member.

22. An electrophotographic copying machine in accordance with claim 20, which further comprises a paper feeding means for feeding papers to said transferring means, a size sensing means disposed in relation to said paper feeding means for sensing a size of paper to be fed therefrom, and a means for moving said LED array in accordance with the size sensed by said size sensing means.

23. An electrophotographic copying machine in accordance with claim 22, wherein said first electrostatic latent image forming means includes a first lens system for focussing said original copy image on said photosensitive member, said first lens system includes a first short focal distance lens array extending generally normal in the displacing direction of said photosensitive member by said displacing means, said LED array being moved generally parallel with said first short focal distance lens array.

24. An electrophotographic copying machine comprising:

a photosensitive member, charging means for charging said photosensitive member, a first light source for exposing an original copy, first electrostatic latent image forming means for forming an original copy image formed by said first light source on said photosensitive member as a first electrostatic latent image, additional information generating means including a data storing medium and for generating an additional information other than said original copy, a second light source for forming an image of said additional information generated by said additional information generating means, and second electrostatic latent image forming means for forming said additional information formed by said second light source on said photosensitive member as a second electrostatic latent image, said photosensitive member including a material sensitive to both said first and second light sources, further developing means for developing said first and second electrostatic latent images formed on said photosensitive member by toner as a toner image, and transferring means for transferring said toner image formed by said developing means on paper.

25. An electrophotographic copying machine in accordance with claim 24, wherein said additional information generating means includes an alphanumeric key and a code generating means for generating a character code corresponding to an operation of said alphanumeric key.

26. An electrophotographic copying machine in accordance with claim 25, which further comprises a displaying means for displaying a character corresponding to said alphanumeric key.

27. An electrophotographic copying machine comprising:

a photosensitive member, charging means for charging said photosensitive member, a first light source for exposing an original copy, first electrostatic latent image forming means for forming an original copy image formed by said first light source on said photosensitive member as a first electrostatic latent image, a second light source for forming an additional information other than said original copy image, and second electrostatic latent image forming means for forming said additional information formed by said second light source on said photosensitive member as a second electrostatic latent image, changing means for changing a size of the electrostatic latent image of said additional information formed on said photosensitive member by said second electrostatic latent image forming means, said photosensitive member including a material sensitive to both said first and second light sources, further developing means for developing said first and second electrostatic latent images formed on said photosensitive member by toner as a toner image, and transferring means for transferring said toner image formed by said developing means on paper.

28. An electrophotographic copying machine in accordance with claim 27, wherein said second light source includes LED array, and said changing means includes a means for changing at least one of the scanning frequency and the luminous pulse width of said LED array.

29. An electrophotographic copying machine in accordance with claim 28, which further comprises a moving means for moving at least one of said original copy and said first light source, and a displacing means for displacing said photosensitive member in relation to the movement of at least one of said original copy and said first light source by said moving means.

30. An electrophotographic copying machine in accordance with claim 29, wherein said displacing means includes a means for displacing said photosensitive member at a constant speed.

31. An electrophotographic copying machine in accordance with claim 29, wherein said displacing means includes a means for changing a displacing speed of said photosensitive member as said changing means.

32. An electrophotographic copying machine in accordance with claim 24, wherein said storing medium stores a plurality of additional information, and further comprises selecting means for selecting at least one of said plurality of additional information stored in said storing medium.

33. An electrophotographic copying machine in accordance with claim 32, wherein said storing means includes a memory.

34. An electrophotographic copying machine in accordance with claim 32, wherein said storing means includes a portable storing medium.

35. An electrophotographic copying machine in accordance with claim 34, wherein said portable storing medium includes a card.

36. An electrophotographic copying machine in accordance with claim 35, wherein said card includes machine readable identification code which functions as said selecting means.

37. An electrophotographic copying machine in accordance with claim 32, which further comprises a displaying means for displaying said additional information which has been selected.

38. An electrophotographic copying machine in accordance with claim 37, wherein said displaying means displays said additional informations in order as selected by said selecting means.

39. An electrophotographic copying machine comprising:

a photosensitive member, charging means for charging said photosensitive member, a first light source for exposing an original copy, first electrostatic latent image forming means for forming an original copy image formed by said first light source on said photosensitive member as a first electrostatic latent image, a second light source for forming an additional information other than said original copy image, and second electrostatic latent image forming means for forming said additional information formed by said second light source on said photosensitive member as a second electrostatic latent image, said photosensitive member including material sensitive to both said first and second light sources, further developing means for developing said first and second electrostatic latent images formed on said photosensitive member by toner as a toner image, said developing means being capable of developing said first and second electrostatic latent images in different colors from each other, and transferring means for transferring said toner image formed by said developing means on paper.

40. An electrophotographic copying machine in accordance with claim 39, wherein said delveloping means includes toner having different colors so as to develop said first and second electrostatic latent images as toner images in each different color.

41. An electrophotographic copying machine in accordance with claim 40, wherein said developing means includes at least two chambers separated in a direction generally normal to the displacing direction of said photosensitive member for storing different toner therein, respectively.

42. An electrophotographic copying machine in accordance with claim 7, wherein said digital signal generating means includes key input means for inputting a key signal, and means for outputting a data corresponding to the inputted key signal.

* * * * *